United States Patent [19]

Fukagai et al.

[11] Patent Number: 4,822,705

[45] Date of Patent: Apr. 18, 1989

[54] ELECTROPHOTOGRAPHIC PHOTOCONDUCTOR WITH LAYER PREVENTING CHARGE INJECTION

[75] Inventors: Toshio Fukagai; Kiyoshi Taniguchi, both of Numazu; Katsuichi Ohta, Mishima; Minoru Umeda; Kayoko Yokoyama, both of Numazu, all of Japan

[73] Assignee: Ricoh Company, Ltd., Tokyo, Japan

[21] Appl. No.: 159,748

[22] Filed: Feb. 24, 1988

[30] Foreign Application Priority Data

| | | | |
|---|---|---|---|
| Feb. 24, 1987 | [JP] | Japan | 62-040751 |
| Feb. 24, 1987 | [JP] | Japan | 62-040752 |
| Feb. 24, 1987 | [JP] | Japan | 62-040753 |
| Feb. 24, 1987 | [JP] | Japan | 62-040754 |
| Feb. 24, 1987 | [JP] | Japan | 62-040755 |
| Feb. 24, 1987 | [JP] | Japan | 62-040756 |
| Mar. 9, 1987 | [JP] | Japan | 62-054813 |
| Mar. 10, 1987 | [JP] | Japan | 62-056075 |
| Mar. 10, 1987 | [JP] | Japan | 62-056076 |
| Jun. 10, 1987 | [JP] | Japan | 62-145884 |

[51] Int. Cl.[4] ..... G03G 5/024; G03G 5/14

[52] U.S. Cl. ..... 430/60; 430/64

[58] Field of Search ..... 430/60, 64

[56] References Cited

U.S. PATENT DOCUMENTS 4,539,282 9/1985 Morimoto et al. ..... 430/59

*Primary Examiner*—Roland E. Martin

*Assistant Examiner*—Jeffrey A. Lindeman

*Attorney, Agent, or Firm*—Oblon, Fisher, Spivak, McClelland & Maier

[57] ABSTRACT

An electrophotographic photoconductor comprising an electroconductive support, an intermediate layer formed thereon, an a photoconductive layer formed on said intermediate layer, which intermediate layer comprises at least one component selected from the group consisting of: (a) monohydric aliphatic alcohol, (b) dihydric aliphatic alcohol, (c) polyethylene glycol, (d) polypropylene glycol, (e) polybutylene glycol, (f) polyethylene glycol monoester and/or polyethylene glycol diester, (g) polyethylene monoether, (h) crown ether, (i) a random or block copolymer having as structure units a hydroxyethylene group and a hydroxypropylene group, and hydroxyl groups at the terminal thereof, and (j) a polymer of a monomer having formula (I) and a copolymer of said monomer and a counterpart monomer:

(I)

wherein $R^1$ represents hydrogen or a methyl group; $R^2$ represents hydrogen, a lower alkyl group or an unsubstituted or substituted aryl group; and n is an integer of 2 to 100.

10 Claims, 1 Drawing Sheet

ELECTROPHOTOGRAPHIC PHOTOCONDUCTOR WITH LAYER PREVENTING CHARGE INJECTION

BACKGROUND OF THE INVENTION

The present invention relates to an improved electrophotographic photoconductor comprising an electroconductive support, an intermediate layer formed on the support which is capable of preventing charge injection from the electroconductive support to a photoconductive layer and a photoconductive layer formed on the intermediate layer.

A variety of trials have been made with an object of providing conventional electrophotographic photoconductors comprising a substrate and an electrophotographic photoconductor formed thereon, in particular, layered-type electrophotographic photoconductors comprising a substrate and an electrophotographic photoconductive layer consisting of a charge generating layer and a charge transporting layer, with a high chargeability, a high photosensitivity and a low residual potential. In one of such trials, it has been proposed to interpose an intermediate layer between an electroconductive support and a charge generating layer of a photoconductive layer, which intermediate layer functions to prevent the injection of electric charge with a polarity opposite to the charging polarity of the photoconductor from the electroconductive support to the charge generating layer. More specifically, intermediate layers made of cellulose nitrate resins are disclosed in Japanese Laid-Open Patent Applications Nos. 47-6341, 48-3544 and 48-12034; intermediate layers made of polyamide resins in Japanese Laid-Open Patent Applications Nos. 48-47344, 52-25638, 58-30757, 58-63947, 58-95351, 58-98739, 60-66258 and 61-110153; an intermediate layer made of vinyl acetate resin in Japanese Laid-Open Patent Application No. 48-26141; intermediate layers made of maleic acid resin in Japanese Laid-Open Patent Applications Nos. 49-69332 and 52-10138; and an intermediate layer of polyvinyl alcohol resin in Japanese Laid-Open Patent Application No. 58-105155.

The electrophotographic photoconductors including such intermediate layers, however, have the shortcomings that when they are used in repetition, the rising rate of the surface potential at the time of the charging of the photoconductors is small, the charging characteristics and obtained image density deteriorate with time, and toner is apt to be deposited on the background of images at the time of reverse development.

SUMMARY OF THE INVENTION

It is therefore an object of the present invention to provide an electrophotographic photoconductor which is capable of yielding excellent images, with the photosensitivity thereof being retained, with no deterioration in charging characteristics, no decrease in image density and no toner deposition on the background of images, even if the photoconductor is used in repetition.

According to the present invention, the above object can be achieved by an electrophotographic photoconductor comprising an electroconductive support, an intermediate layer formed thereon, and a photoconductive layer formed on the intermediate layer, which intermediate layer comprises as the main component any of the following compounds: (1) monohydric aliphatic alcohol, (2) dihydric aliphatic alcohol, (3) polyethylene glycol, (4) polypropylene glycol, (5) polybutylene glycol, (6) polyethylene glycol monoester and/or polyethylene glycol diester, (7) polyethylene monoether glycol, (8) crown ether, (9) a random or block copolymer having as its structure units a hydroxyethylene group and a hydroxypropylene group, and a hydroxyl group at the terminal of the molecule thereof, and (10) a polymer of a monomer having the following formula and a copolymer of the monomer and other compolymerizable compounds:

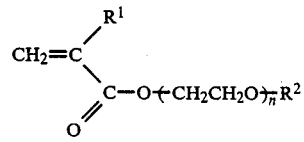

wherein $R^1$ represents hydrogen or a methyl group; $R^2$ represents hydrogen, a lower alkyl group or an unsubstituted or substituted aryl group; and n is an integer of 2 to 100.

DETAILED DESCRIPTION OF THE PREFERRED EMBODIMENTS

Figure 1:
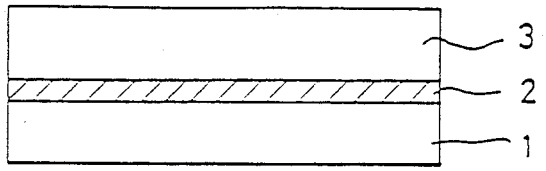
FIG. 1 is a schematic cross-sectional view of an example of an electrophotographic photoconductor according to the present invention.

FIG. 1 is a schematic cross-sectional view of an example of an electrophotographic photoconductor according to the present invention. In the figure, reference numeral 1 indicates an electroconductive support, reference numeral 2, a charge-injection preventing intermediate layer (hereinafter referred to as the intermediate layer), which is formed on the electroconductive support 1. Reference numeral 3 indicates a photoconductive layer of a single layer type.

Figure 2:
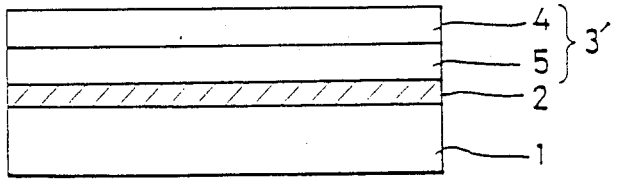
FIG. 2 is a schematic cross-sectional view of another example of an electrophotographic photoconductor according to the present invention.

FIG. 2 is a schematic cross-sectional view of another example of an electrophotographic photoconductor according to the present invention. In this figure, reference numeral 3' indicates a two-layered type photoconductive layer which consists of a charge generating layer 4 and a charge transporting layer 5. The reference numerals 1 and 2 respectively indicate the same electroconductive support and the intermediate layer as those employed in the photoconductor shown in FIG. 1.

In the above electrophotographic photoconductors according to the present invention, the electroconductive support 1 serves to supply an electric charge having a polarity opposite to that of the electric charge for charging the photoconductor towards the electroconductive support 1. It is preferable that the electric resistivity of the electrocconductive support 1 be $10^8$ Ωcm or less, and that the electroconductive support be resistant to various conditions for forming thereon an intermediate layer, a charge transporting and a charge generating layer.

Such an electroconductive support may be made of an electroconductive metal, for example, Al, Ni, Cr, Zn and stainless steel and alloys thereof. The electroconductive support may be support comprising (i) an inorganic insulating substrate made of, for example, glass or ceramics, or an organic insulating substrate made of, for example, polyester, polyimide, phenol resin, nylon resin, or paper, and (ii) an electroconductive coating layer formed on the substrate by vacuum deposition, sputtering or spray coating, which electroconductive coating layer is made of an electroconductive material such as Al, Ni, Cr, Zn, stainless steel, carbon, $SnO_2$ and $In_2O_3$.

The intermediate layer serves to inhibit the charge injection from the electroconductive support to the photoconductive layer to retain the charged state of the photoconductive layer at the time of the charging of the photoconductive layer, and to transport the electric charge generated in the photoconductive layer during the exposure of the photoconductive layer to light images (that is, the electric charge having a polarity opposite to the polarity of the charge retained at the side of the electroconductive support) to the electroconductive support. In particular, when the photoconductive layer has high photosensitivity, the intermediate layer is necessary because if no charge injection preventing intermediate layer is provided, the chargeability of the photoconductive layer is reduced.

Monohydric Aliphatic Alcohols for Use in the Intermediate Layer

It is preferable that the monohydric aliphatic alcohol for use in the present invention have 5 or more carbon atoms, more preferably 12 to 25 carbon atoms.

Specific examples of such a monohydric aliphatic alcohol are n-amyl alcohol, isoamyl alcohol, 2-methyl-1-butanol, n-hexyl alcohol, n-heptyl alcohol, pentamethyl alcohol, n-octyl alcohol, n-nonyl alcohol, lauryl alcohol, myristyl alcohol, cetyl alcohol, stearyl alcohol, n-eicosyl alcohol, n-docosanol, ceryl alcohol, octacocyl alcohol, n-triacontyl alcohol, and melissyl alcohol. In the present invention, it is more preferable to use a monohydric higher aliphatic alcohol having 12 or more carbon atoms, such as lauryl alcohol, miristyrl alcohol, cetyl alcohol, stearyl alcohol, n-eichosyl alcohol, n-docosanol and ceryl alcohol.

Dihydric Aliphatic Alcohols for Use in the Intermediate Layer

It is preferable that the dihydric aliphatic alcohol for use in the present invention have 3 to 20 carbon atoms.

Specific examples of such a dihydric aliphatic alcohol are ethylene glycol, propylene glycol, ethylethylene glycol, 2,3-butanediol, 2-methyl-1,2-propanediol, 1,2-pentanediol, 2,3-pentanediol, threo-2,3-pentanediol, erythro-2,3-pentanediol, 3-methyl-1,2-butanediol, 2-methyl-1,2-butanediol, 2-methyl-2,3-butanediol, pinacol, trimethine glycol, 1,3-butanediol, 2,4-pentanediol, 2-methyl-2,4-butanediol, 2-methyl-2,4-pentanediol, 2,4-dimethyl-2,4-pentanediol, hexamethyltrimethylene glycol, 2,2-dimethyl-trimethylene glycol, 2,2-dimethyl-1,3-butanediol, 2,2-dimethyl-1,3-pentanediol, tetramethylene glycol, 2,2,4-trimethyl-1,3-pentadiol, γ-pentylene glycol, 2-methyl-2,5-pentadiol, 3-methyl-2,5-pentanediol, 1,4-hexanediol, 2,5-hexanediol, 2,5-dimethyl-2,5-hexanediol, pentamethylene glycol, 1,5-hexanediol, hexamethylene glycol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,12-octadecanediol, and 1,18-octadecanediol.

Polyethylene Glycols for Use in the Intermediate Layer

It is preferable that the polyethylene glycols for use in the intermediate layer be commercially available polyethylene glycols having a molecular weight of 60 to 5,000,000, more preferably polyethylene glycols having a molecular weight of 200 to 50,000.

Polypropylene Glycols for Use in the Intermediate Layer

It is preferable that the propylene glycols for use in the intermediate layer be commercially available polypropylene glycols having a molecular weight of 70 to 10,000, more preferably polypropylene glycols having a molecular weight of 500 to 5,000.

Polybutylene Glycols for Use in the Intermediate Layer

It is preferable that the polybutylene glycols for use in the intermediate layer be commercially available polybutylene glycols having a molecular weight of 90 to 40,000, more preferably polybutylene glycols having a molecular weight of 90 to 8,000.

Polyethylene Glycol Monoesters and Diesters for Use in the Intermediate Layer It is preferable that the polyethylene glycol monoesters and diesters for use in the intermediate layer be polyethylene glycol monoesters having the following general formula (I) and polyethylene glycol diesters having the following general formula (II):

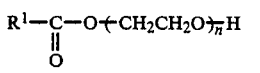

(I)

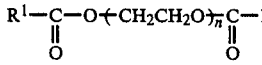

(II)

wherein $R^1$ and $R^2$ each represent an alkyl group having 1 to 30 carbon atoms, preferably an alkyl group having 10 to 20 carbon atoms, n is an integer of 1 or more, preferably an integer of 1 to 30, indicating an average number of added mole units.

As such polyethylene glycol monoester and polyethylene glycol diester, it is preferable to use commoercially available monoesters and diesters having a molecular weight of 100 to 10,000, more preferably monoesters and diesters having a molecular weight of 100 to 2000.

Polyethylene Glycol Monoethers for Use in the Intermediate Layer

It is preferable that the polyethylene glycol monoethers for use in the intermediate layer be polyethylene glycol monoethers having the following general formula (III):

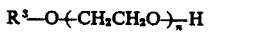

(III)

wherein $R^3$ represents an alkyl group having 1 to 30 carbon atoms, more preferably an alkyl group having 10 to 20 carbon atoms, an unsubstituted or substituted aryl group, preferably a phenyl group having as a substituent an alkyl group having 1 to 20 carbon atoms, and n is an integer of 1 or more, preferably an integer of 1 to 100, indicating an average number of added mole units.

As such a polyethylene glycol monoether, it is preferable to use commercially available monoether having a molecular weight of 70 to 10,000, more preferably monoether having a molecular weight of 200 to 5000.

Crown Ethers for Use in the Intermediate Layer

It is preferable that the crown ethers for use in the intermediate layer be crown ethers having 3 to 8 carbon atoms. Specific examples of such crown ethers are as follows:

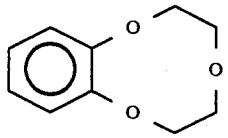

Benzo-9-crown-3-ether

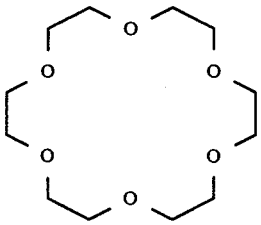

18-crown-6-ether

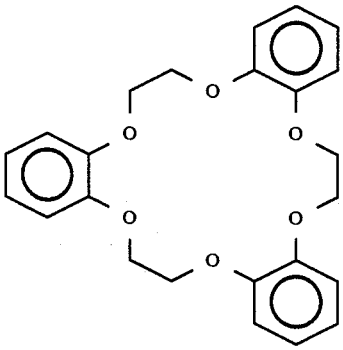

Tribenzo-18-crown-6-ether

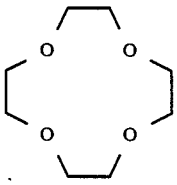

12-crown-4-ether

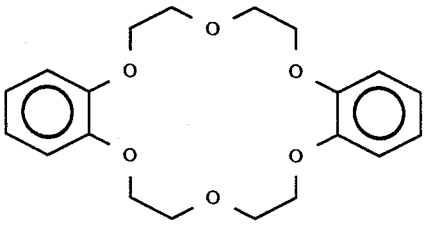

Dibenzo-18-crown-6-ether

-continued

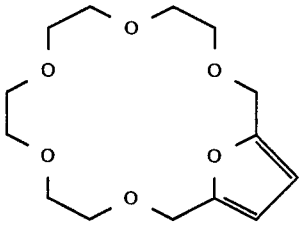

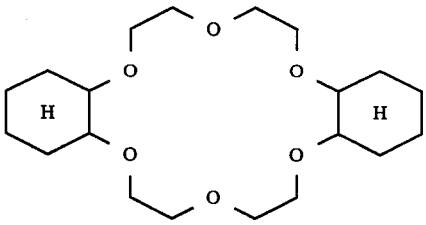

Perhydrobenzo-18-crown-6-ether

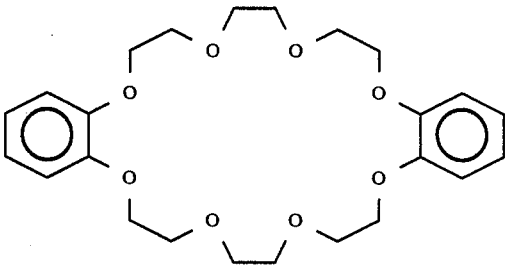

Dibenzo-24-crown-8-ether

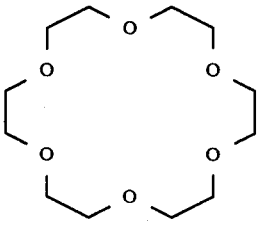

18-crown-6-ether

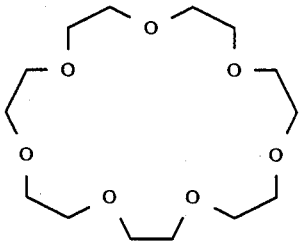

21-crown-7-ether

-continued

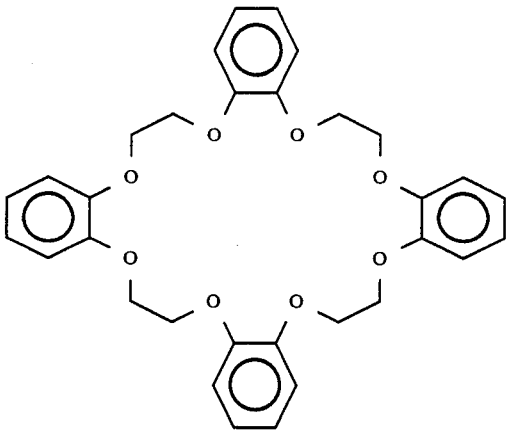

Tetrabenzo-24-crown-8-ether

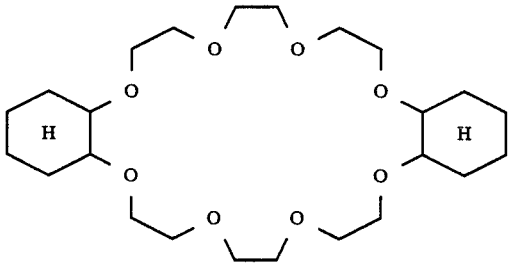

Dicyclohexano-24-crown-8-ether

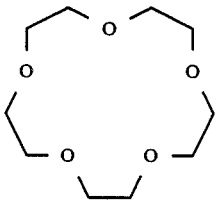

15-crown-5-ether

Random or Block Copolymers for Use in the Intermediate Layer

It is preferable that random or block copolymers having as the structure units thereof hydroxyethylene groups and hydroxypropylene groups, and a hydroxyl group at the terminal of the molecule for use in the intermediate layer be commercially available random or block copolymers having a molecular weight of 500 to 100,000, more preferably 2,000 to 50,000, with an average number of added hydroxyethylene groups being 1 to 1,000, more preferably 1 to 600, and with an average number of added hydroxypropylene groups being 1 to 2,000, more preferably 1 to 1,000.

Specific examples of such random copolymers and block copolymers are Newpol PE-61, PE-62, PE-64, PE-68, PE-71, PE-74, PE-75, PE-78, PE-85, PE-88, PE-108, PE-2700, and Newpol 75H-90000 (made by Sanyo Chemical Industries, Ltd.); Pluronic L Series, P Series, and F Series (made by Asahi Denka Kogyo K.K); Epan Series (made by Dai-Ichi Kogyo Seiyaku Co., Ltd.); and Plonon 102, 104, 105, 201, 204 and 208 (made by Nippon Oils & Fats Co., Ltd.).

Polymers and Copolymers for Use in the Intermediate Layer

It is preferable that polymers and copolymers for use in the intermediate layer be polymers of a monomer having the following formula (IV) and a copolymer of the monomer and other copolymerizable compounds:

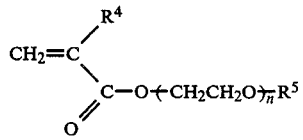

(IV)

wherein $R^4$ represents hydrogen or a methyl group; $R^5$ represents hydrogen, a lower alkyl group or an unsubstituted or substituted aryl group; and n is an integer of 2 to 100.

Specific examples of a monomer having the above formula (IV) for such polymer and copolymer are as follows:

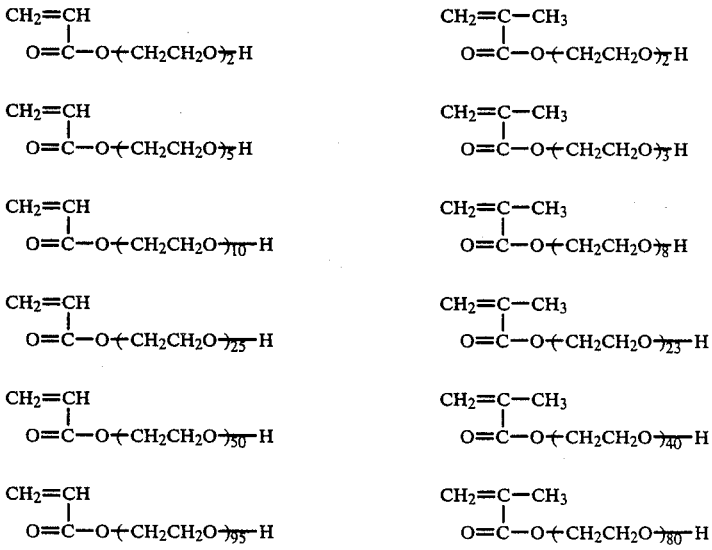

-continued $CH_2{=}CH(C{=}O)O(CH_2CH_2O)_{3}CH_3$ $CH_2{=}CH(C{=}O)O(CH_2CH_2O)_{9}CH_3$ $CH_2{=}CH(C{=}O)O(CH_2CH_2O)_{12}CH_3$ $CH_2{=}CH(C{=}O)O(CH_2CH_2O)_{30}CH_3$ $CH_2{=}CH(C{=}O)O(CH_2CH_2O)_{60}CH_3$ $CH_2{=}CH(C{=}O)O(CH_2CH_2O)_{90}CH_3$ $CH_2{=}CH(C{=}O)O(CH_2CH_2O)_{3}C_2H_5$ $CH_2{=}CH(C{=}O)O(CH_2CH_2O)_{10}C_2H_5$ $CH_2{=}CH(C{=}O)O(CH_2CH_2O)_{55}C_2H_5$ $CH_2{=}CH(C{=}O)O(CH_2CH_2O)_{9}CH_2CH_2CH_3$ $CH_2{=}C(CH_3)(C{=}O)O(CH_2CH_2O)_{8}CH_2CH_2CH_3$ $CH_2{=}CH(C{=}O)O(CH_2CH_2O)_{45}CH_2CH_2CH_3$ $CH_2{=}C(CH_3)(C{=}O)O(CH_2CH_2O)_{55}CH_2CH_2CH_3$ $CH_2{=}CH(C{=}O)O(CH_2CH_2O)_{2}CH_2CH_2CH_2CH_3$ $CH_2{=}C(CH_3)(C{=}O)O(CH_2CH_2O)_{9}CH_2CH_2CH_2CH_3$ $CH_2{=}CH(C{=}O)O(CH_2CH_2O)_{30}CH_2CH_2CH_2CH_3$ $CH_2{=}C(CH_3)(C{=}O)O(CH_2CH_2O)_{90}CH_2CH_2CH_2CH_3$

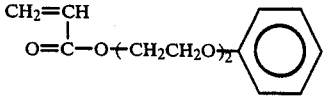

$CH_2{=}C(CH_3)(C{=}O)O(CH_2CH_2O)_{2}H$ $CH_2{=}C(CH_3)(C{=}O)O(CH_2CH_2O)_{4}CH_3$ $CH_2{=}C(CH_3)(C{=}O)O(CH_2CH_2O)_{9}CH_3$ $CH_2{=}C(CH_3)(C{=}O)O(CH_2CH_2O)_{23}CH_3$ $CH_2{=}C(CH_3)(C{=}O)O(CH_2CH_2O)_{45}CH_3$ $CH_2{=}C(CH_3)(C{=}O)O(CH_2CH_2O)_{90}CH_3$ $CH_2{=}C(CH_3)(C{=}O)O(CH_2CH_2O)_{4}C_2H_5$ $CH_2{=}C(CH_3)(C{=}O)O(CH_2CH_2O)_{28}C_2H_5$ $CH_2{=}C(CH_3)(C{=}O)O(CH_2CH_2O)_{83}C_2H_5$

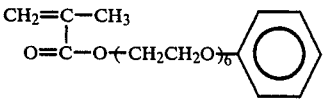

-continued

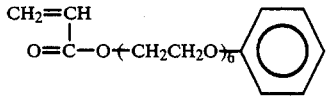

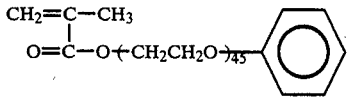

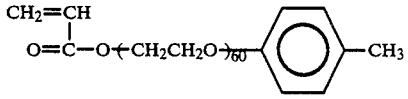

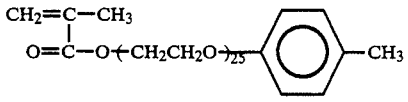

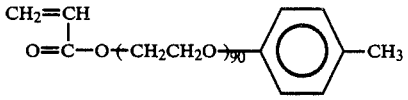

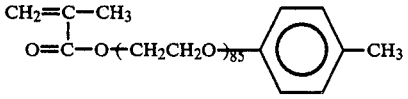

Examples of other copolymerizable compounds with the monomers of the above general formula (IV) are acrylic esters, acrylamides, methacrylic esters, methacrylamides, allyl compounds, vinyl ethers, vinyl esters, styrene and styrene derivatives, crotonic acid esters, each of which has one unsaturated bond suitable for addition polymerization. Specific examples of such compounds are alkyl acrylates (for example, methyl acrylate, ethyl acrylate, propyl acrylate, butyl acrylate, amyl acrylate, ethylhexyl acrylate, octyl acrylate, t-octyl acrylate, chloroethyl acrylate, 2-hydroxyethyl acrylate, 2-hydroxypropyl acrylate, 2-hydroxybutyl acrylate, 2-hydroxystyrene acrylate, 2,2-dimethylhydroxypropyl acrylate, 5-hydroxypentyl acrylate, trimethylolpropane monoacrylate, pentaerythritol monoacrylate, glycidyl acrylate, methaglycidyl acrylate, trifluoroethyl acrylate, cyclohexyl acrylate, 2-methoxyethyl acrylate, 2-ethoxyethyl acrylate, 2-ethoxyethyl acrylate, 2-butoxyethyl acrylate, 2-phenoxyethyl acrylate, dimethylaminoethyl acrylate, diethylaminoethyl acrylate, di-(n-butyl)aminoethyl acrylate, di-(t-butyl)aminoethyl acrylate, N-(t-butyl)aminoethyl acrylate, benzyl acrylate, methoxybenzyl acrylate, furfuryl acrylate, and tetrahydrofurfuryl acrylate); aryl acrylates (for example, phenyl acrylate); methacrylic acid esters, for example, alkyl methacrylates (for example, methyl methacrylate, ethyl methacrylate, propyl methacrylate, isopropyl methacrylate, amyl methacrylate, hexyl methacrylate, cyclohexyl methacrylate, benzyl methacrylate, chlorobenzyl methacrylate, octyl methacrylate, 2-hydroxyethyl methacrylate, 3-hydroxypropyl methacrylate, 2-hydroxybutyl methacrylate, 2-hydroxystyrene methacrylate, 4-hydroxybutyl methacrylate, 5-hydroxypentyl methacrylate, 2,2-dimethyl-3-hydroxypropyl methacrylate, trimethylolpropane monomethacrylate, pentaerythritol monomethacrylate, glycidyl methacrylate, methaglycidyl methacrylate, trifluoroethyl methacrylate, 2-methoxyethyl methacrylate, 2-ethoxyethyl methacrylate, 2-butoxyethyl methacrylate, 2-phenoxyethyl methacrylate, dimethylaminoethyl methacrylate, diethylaminoethyl methacrylate, di-(n-butyl)aminoethyl methacrylate, di-(t-butyl)aminoethyl methacrylate, N-(t-butyl)aminoethyl methacrylate, furfuryl methacrylate, and tetrahydrofurfuryl methacrylate), aryl methacrylates (for example, phenyl methacrylates); acrylamides, for example, acrylamides, N-alkylacrylamides (examples of the alkyl group are methyl, ethyl, propyl, butyl, t-butyl, heptyl, octyl, cyclohexyl, hydroxyethyl, and benzyl), N-arylacrylamides (examples of the aryl group are phenyl group, tolyl group, nitrophenyl group, naphthyl group and hydroxyphenyl group), N,N-dialkylacrylamides (examples of the alkyl group are methyl group, ethyl group, butyl group, isobutyl group, ethylhexyl group and cyclohexyl group), N,N-diarylacrylamide (an example of the aryl group is phenyl group), N-methyl-N-phenylacrylamide, N-hydroxyethyl-N-methylacrylamide, N-2-acetoamidoethyl-N-acetylacrylamide; methacrylamides, for example, methacrylamide, N-alkylmethacrylamides (examples of the alkyl group are methyl group, ethyl group, t-butyl group, ethylhexyl group, hydroxyethyl group and cyclohexyl group), N-arylmethacrylamide (an example of the aryl group is phenyl group), N,N-dialkyl-methacrylamides (examples of the alkyl group are ethyl group, propyl group and butyl group), N,N-diarylmethacrylamides (an example of the aryl group is phenyl group), N-hydroxyethyl-N-phenylmethacrylamide, N-ethyl-N-phenyl-methacrylamide; allyl compounds, for example, allyl esters (for example, allyl acetate, allyl caproate, allyl caprylate, allyl laurate, allyl palmitate, allyl stearate, allyl benzoate, allyl acetoacetate and allyl lactate) and allyloxy ethanol; vinyl ethers, for example, alkylvinyl ethers (for example, hexyl vinyl ether, octyl vinyl ether, decyl vinyl ether, ethyl hexyl vinyl ether, methoxyethyl vinyl ether, ethoxyethyl vinyl ether, chloroethyl vinyl ether, 1-methyl-2,2-dimethylpropyl vinyl ether, 2-ethyl butyl ether, hydroxyethyl vinyl ether, diethylene glycol vinyl ether, dimethylaminoethyl vinyl ether, diethylaminoethyl vinyl ether, butylaminoethyl vinyl ether, benzyl vinyl ether, and terahydrofurfuryl vinyl ether), vinyl aryl ethers (for example, vinyl phenyl ether, vinyl tolyl ether, vinyl chlorophenyl ether, vinyl-2,4-dichlorophenyl ether, vinyl naphthyl ether, and vinyl anthranil ether); vinyl esters, for example, vinyl butylate, vinyl isobutylate, vinyl trimethyl acetate, vinyl diethyl acetate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl-β-phenylbutyrate, vinyl cyclohexyl carboxylate, vinyl benzoate, vinyl salicylate, vinyl chlorobenzoate, vinyl tetrachlorobenzoate, and vinyl naphthoate; styrene and derivatives thereof, for example, styrene and alkylstyrene (for example, methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, and acetoxylmethylstyrene), alkoxystyrenes (for example, methoxystyrene, 4-methoxy-3-methylstyrene, and dimethoxystyrene), halogenostyrenes (for example, chorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, and 4-fluoro-3-trifluoromethylstyrene); crotonic acid esters, for example, alkyl crotonates (for example, butyl crotonate, hexyl crotonate, and glycerin monocronate); dialkyl itaconates (for example, dimethyl itaconate, diethyl itaconate and dibutyl itaconate); and dialkyl maleates and dialkyl fumarates (for example, dimethyl fumarate and dibutyl fumarate). In addition, acrylonitrile, methacrylonitrile, acrylic acid and methacrylic acid can be employed. However, multi-functional unsaturated componds having two or more polymerizable vinyl groups per molecule are not suitable for use in the intermediate layer in the present invention.

In the intermediate layer of the present invention, other conventional resins may be employed in combination with any of the above main components.

Examples of such other conventional resins are thermoplastic resins such as polyester, polycarbonate, polyvinyl butyral, polyamide, polystyrene, polyurethane, polypropylene, polyacrylate, and polyvinyl chloride; thermosetting resins such as phenol resin, melamine resin, and epoxy resin; and photosetting resins. Furthermore, electroconductive powders such as $SnO_2$ and $Sb_2O_3$, and/or white pigments such as ZnO, ZnS and $TiO_2$ may be contained in the intermediate layer.

The intermediate layer can be formed on the electroconductive substrate by coating an intermediate layer coating liquid by using a conventional coating method such as the roll coating method, the immerse coating method, the spray coating method, and the blade coating method, to form a thin layer and drying and hardening the same at 50° C. to 200° C. to form an intermediate layer having a thickness of 0.05 to 10 μm, more preferably an intermediate layer having a thickness of 0.2 μm to 2 μm.

The photoconductive layer in the present invention may be either of a single layer type as shown in FIG. 1 or a plural layer type as shown in FIG. 2.

The single layer type photoconductive layer has both a charge generating function and a charge transporting function and serves to form latent electrostatic images thereon upon being exposed to light images.

A photoconductive layer of this kind, which is formed on the intermediate layer, comprises a photoconductive powder made of, for instance, zinc oxide, titanium oxide and zinc sulfide which are sensitized by a pigment; an amorphous silicon powder, crystalline selenium powder, copper phthalocyanine pigment, an azo pigment; and a binder agent, and a charge generating material when necessary as will be explained later. Alternatively, a single layer comprising a eutectic crystal complex of a pyrylium dye and Bisphenol A type polycarbonate, with addition thereto of a charge generating material may be employed as a photoconductive layer. It is preferable that the thickness of the photoconductor be in the range of 5 μm to 30 μm.

A charge generating layer of a layered type photoconductor serves to generate electric charge pairs when exposed to light and to separate the same. The charge generating layer in the present invention contains an organic pigment of dye, crystalline selenium or arsenic selenide as charge generating material. Examples of such an organic pigment or dye are phthalocyanine pigments, bisazo pigments, trisazo pigments, perylene pigments, squalic salt dyes, azulenium salt dyes, and quinone condensate polycyclic compounds.

Specific examples of disazo pigments and trisazo pigments are shown in Table 1:

TABLE 1

| Pigment No. | A |
|---|---|
| 1 | 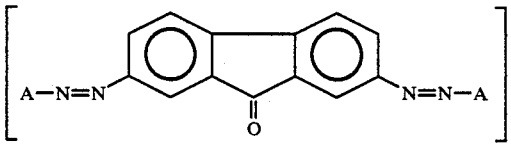  |
| | 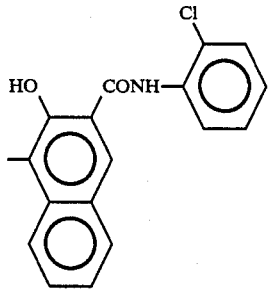  |

TABLE 1-continued
| Pigment No. | A |
|---|---|
| 2 | 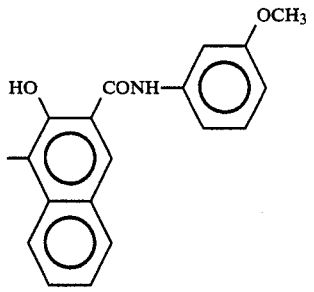 |
| 3 | 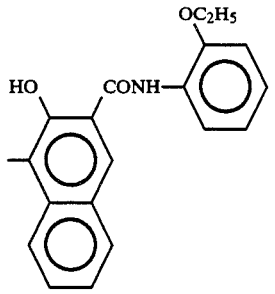 |
| 4 | 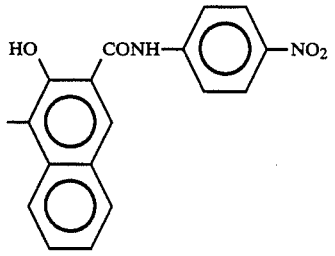 |
| 5 | 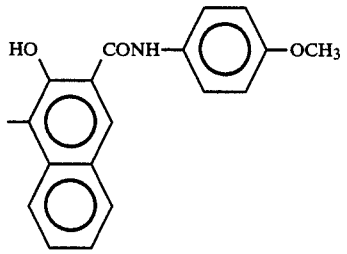 |
| 6 | 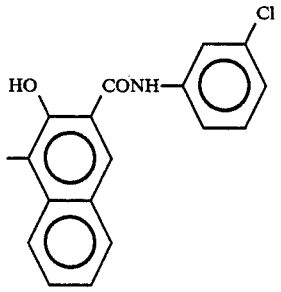 |

TABLE 1-continued
| Pigment No. | A |
|---|---|
| 7 | 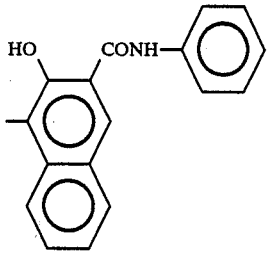 |
| 8 | 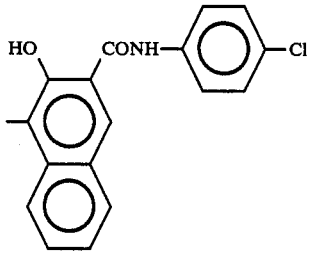 |
| 9 | 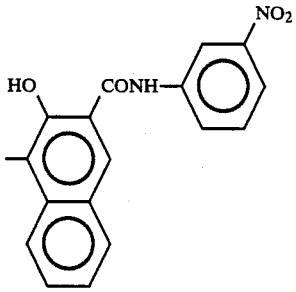 |
| 10 | 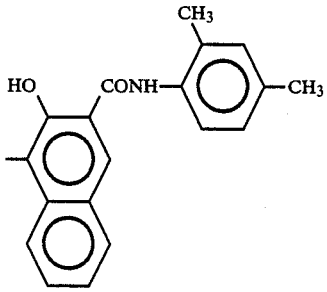 |
| 11 | 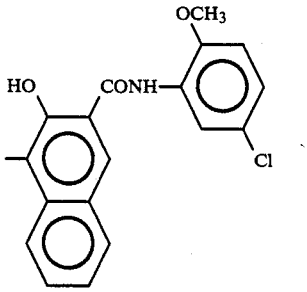 |

TABLE 1-continued
| Pigment No. | A |
|---|---|
| 12 | 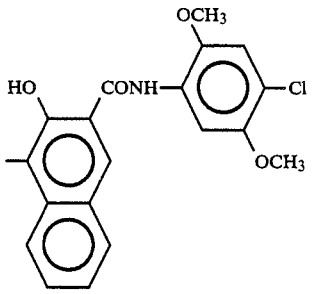 |
| 13 | 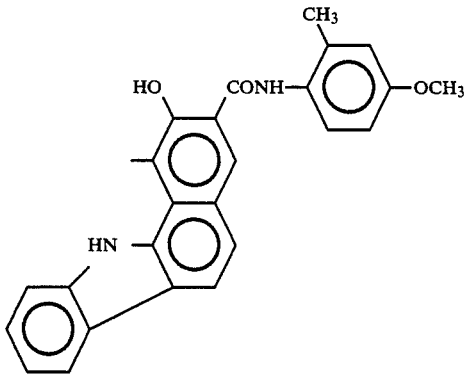 |
| 14 | 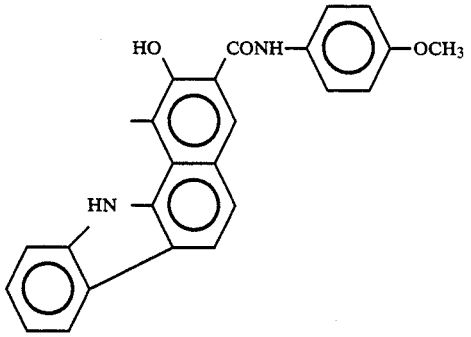 |
| 15 | 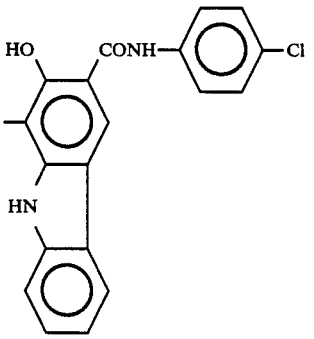 |

TABLE 1-continued
| Pigment No. | A |
|---|---|
| 16 | 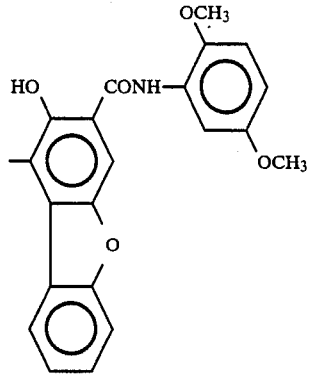 |
| 17 | 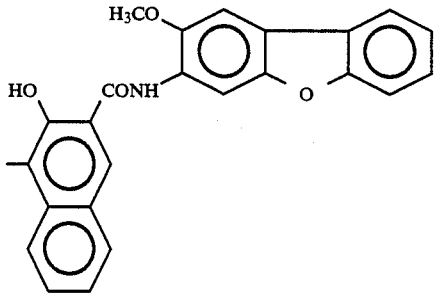 |
| 18 | 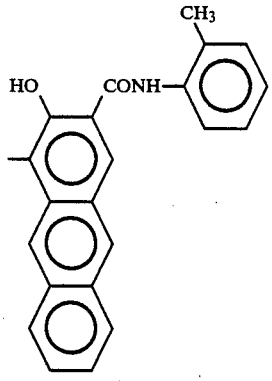 |
| 19 | 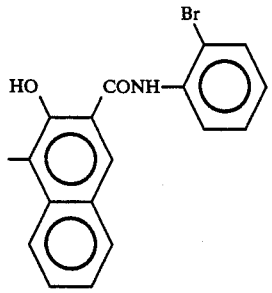 |
| 20 | 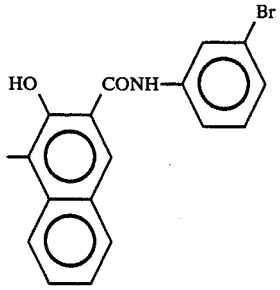 |

TABLE 1-continued
| Pigment No. | A |
|---|---|
| 21 | 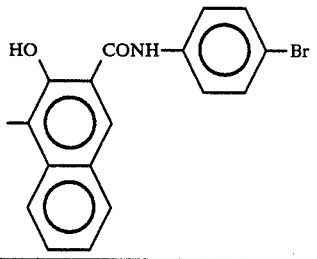 |
| | 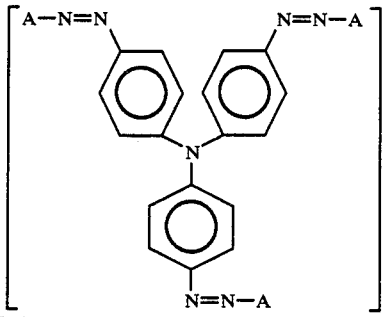 |
| 22 | 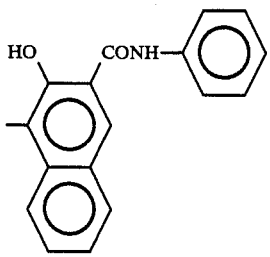 |
| 23 | 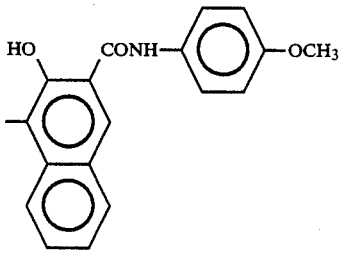 |
| 24 | 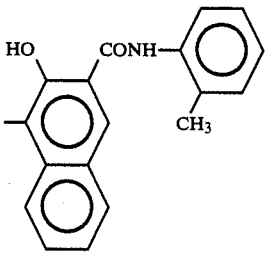 |

TABLE 1-continued
| Pigment No. | A |
|---|---|
| 25 | 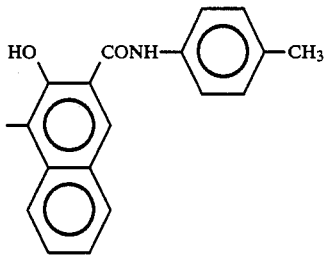 |
| 26 | 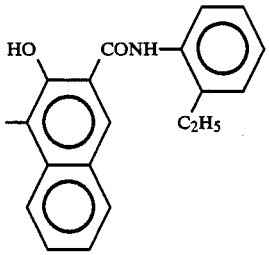 |
| 27 | 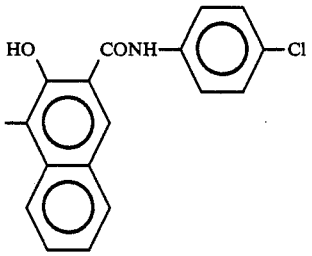 |
| 28 | 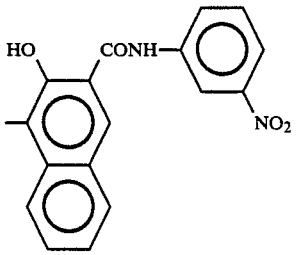 |
| 29 | 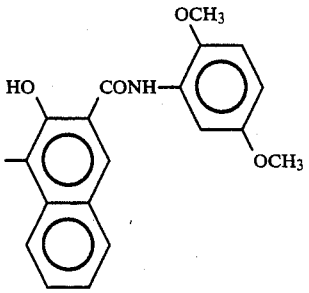 |

TABLE 1-continued
| Pigment No. | A |
|---|---|
| 30 | 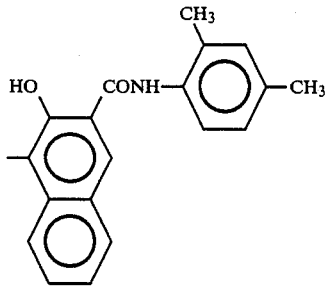 |
| 31 | 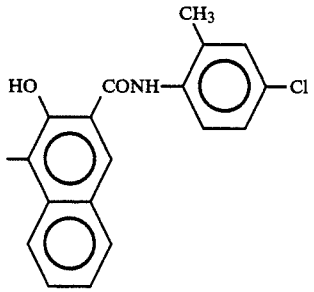 |
| 32 | 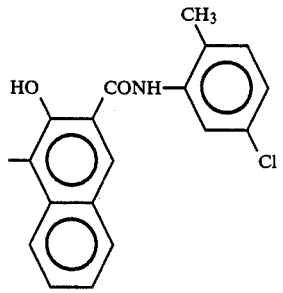 |
| 33 | 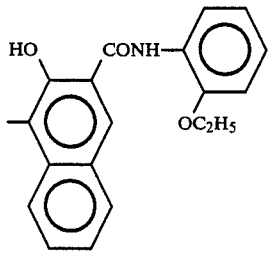 |
| 34 | 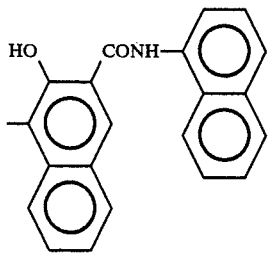 |

TABLE 1-continued
| Pigment No. | A |
|---|---|
| 35 | 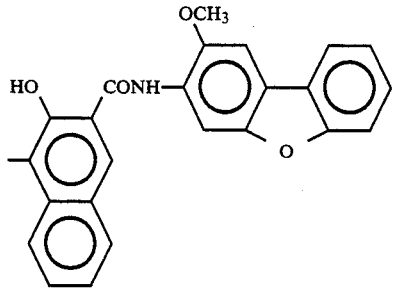 |
| 36 | 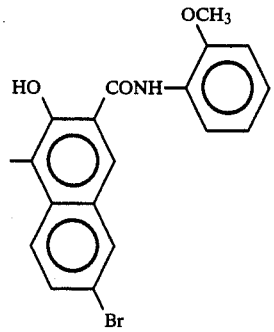 |
| 37 | 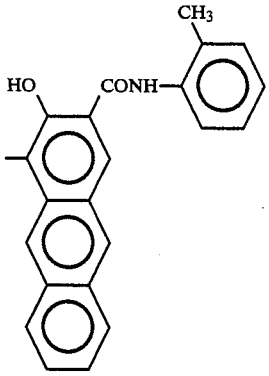 |
| 38 | 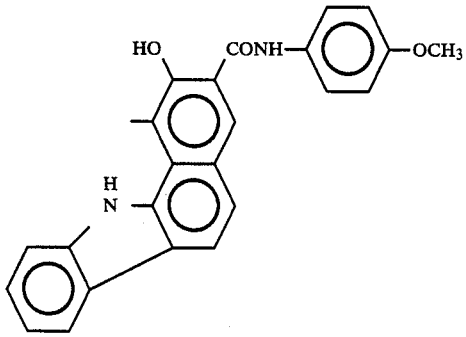 |

TABLE 1-continued
| Pigment No. | A |
|---|---|
| 39 | 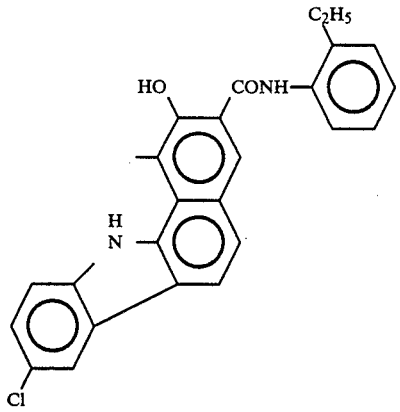 |
| 40 | 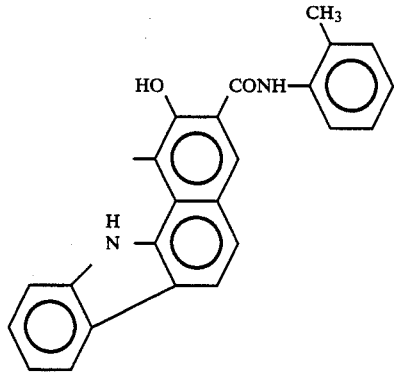 |
| 41 | 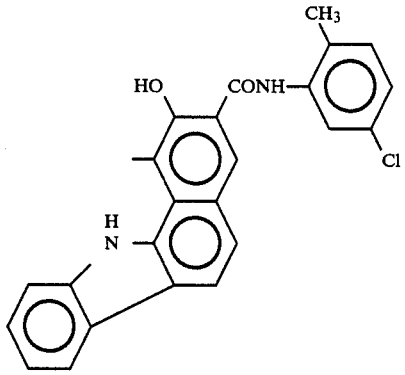 |
| 42 | 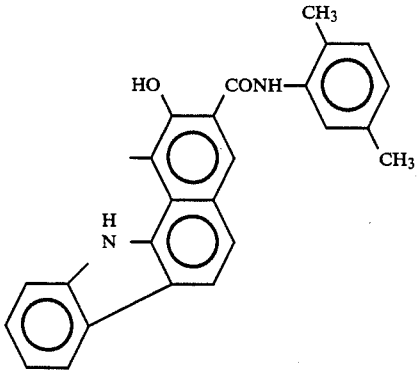 |

TABLE 1-continued
| Pigment No. | A |
|---|---|
| 43 | 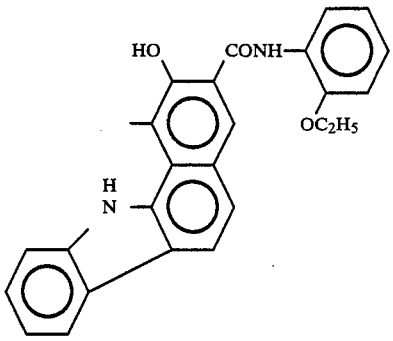 |
| 44 | 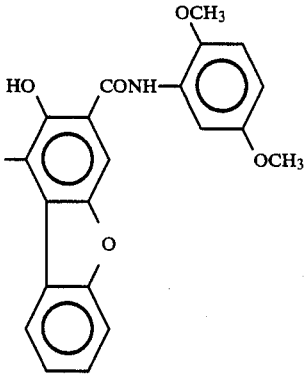 |
| 45 | 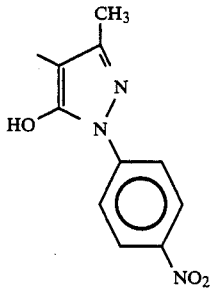 |
| 46 | 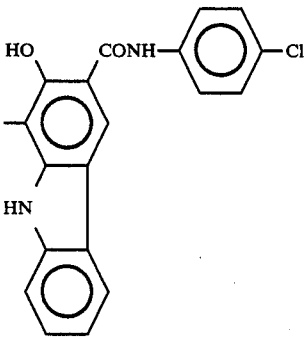 |

TABLE 1-continued
| Pigment No. | A |
|---|---|
| 47 | 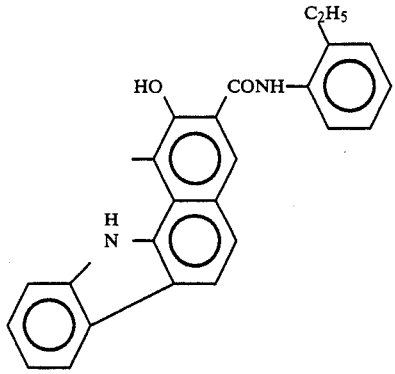 |
| 48 | 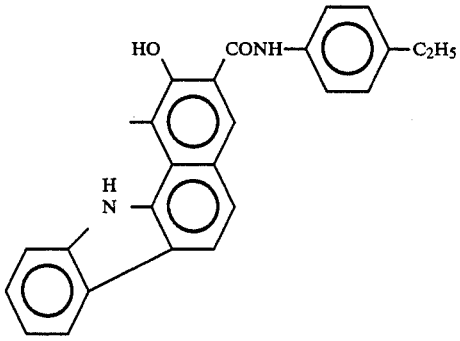 |
| | 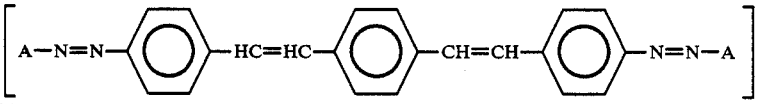 |
| 49 | 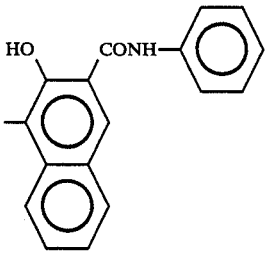 |
| 50 | 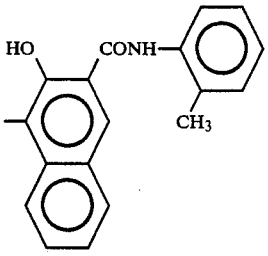 |
| 51 | 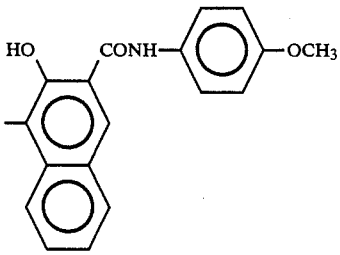 |

TABLE 1-continued
| Pigment No. | A |
|---|---|
| 52 | 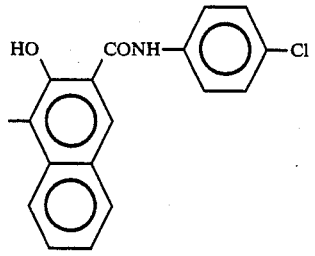 |
| 53 | 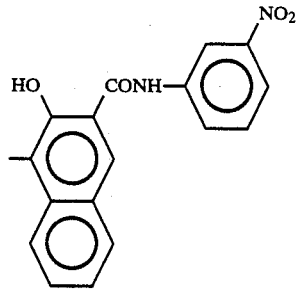 |
| 54 | 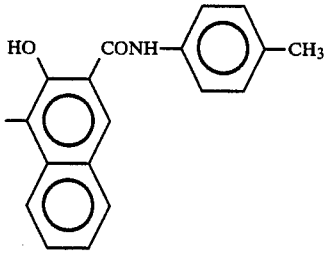 |
| 55 | 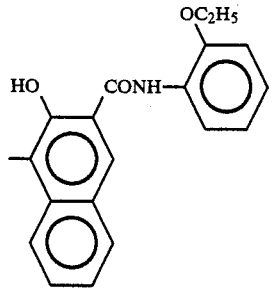 |
| 56 | 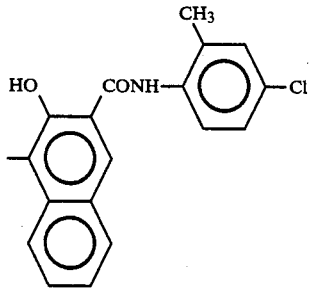 |

TABLE 1-continued
| Pigment No. | A |
|---|---|
| 57 | 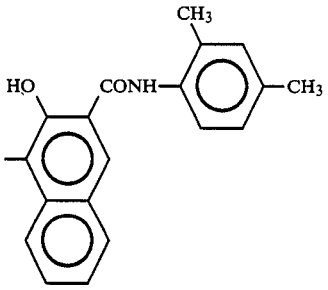 |
| 58 | 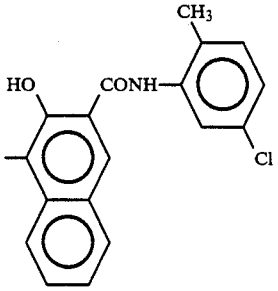 |
| 59 | 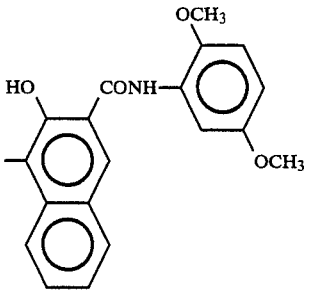 |
| 60 | 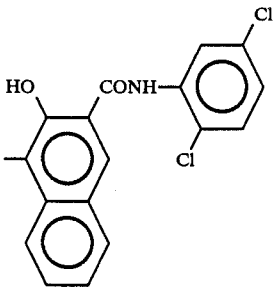 |
| 61 | 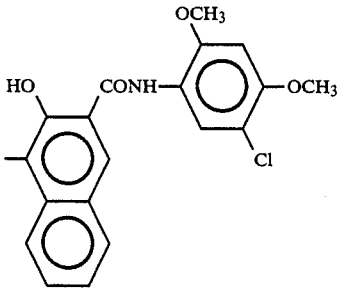 |

TABLE 1-continued
| Pigment No. | A |
|---|---|
| 62 | 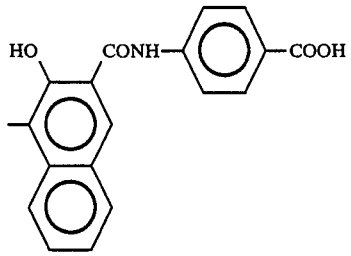 |
| 63 | 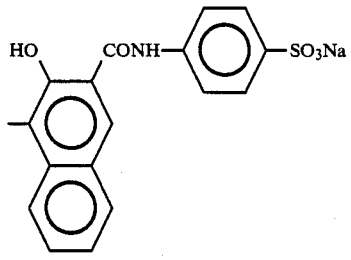 |
| 64 | 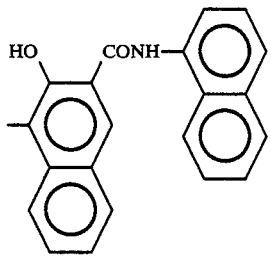 |
| 65 | 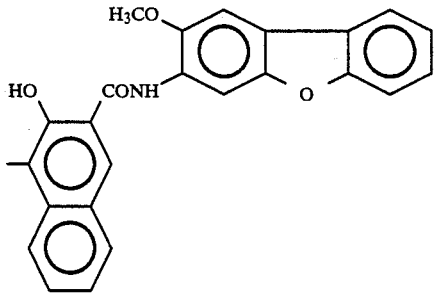 |
| 66 | 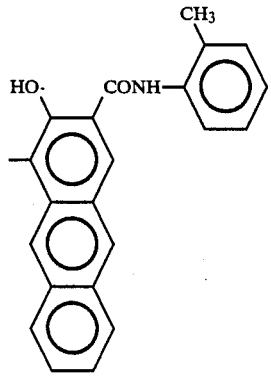 |

TABLE 1-continued
| Pigment No. | A |
|---|---|
| 67 | 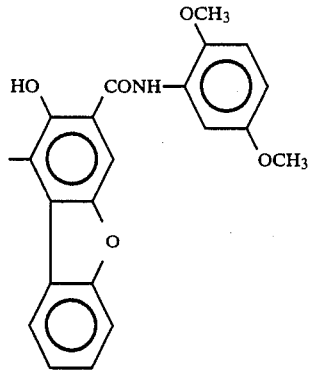 |
| 68 | 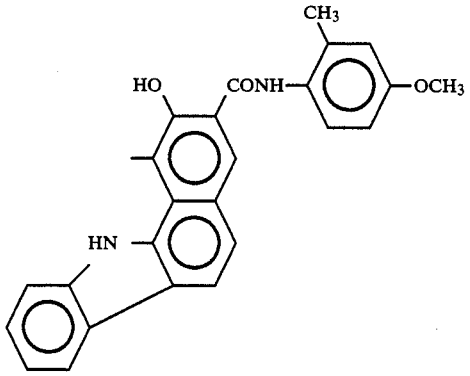 |
| 69 | 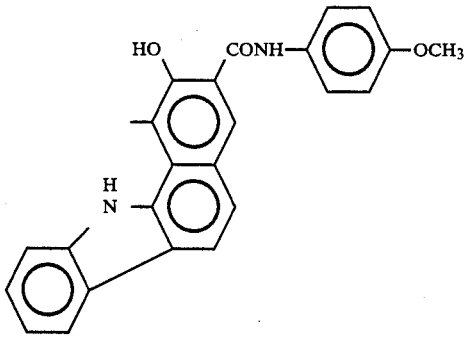 |
| 70 | 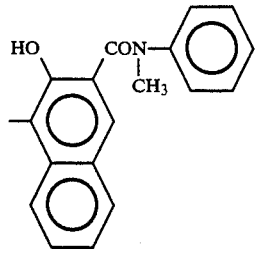 |
| 71 | 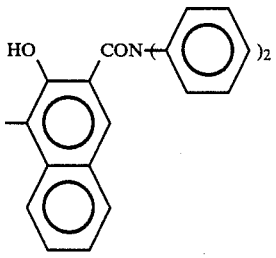 |

TABLE 1-continued

| Pigment No. | A |
|---|---|
| 72 | 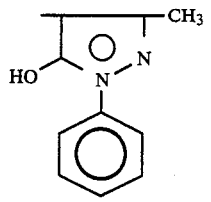 |
| 73 | 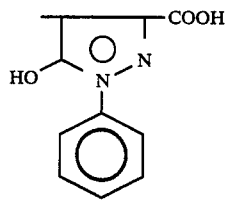 |
| 74 | 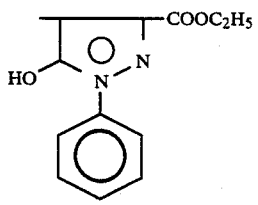 |

These organic dyes and pigments are used by dispersing in an organic solvent, with or without resin(s), by using a ball mill, an ultrasonic wave mill, a three-roll mill, a sand grinder, an attritor, an impeller, and a stone mill.

It is required that the resins used for dispersing these organic dyes and pigments have insulating property and adhesiveness. Examples of such resins are condensation resins such as polyamide, polyurethane, polyester, epoxy resin, polycarbonate, and polyether, and other polymers and copolymers such as polystyrene, polyacrylate, polymethacrylate, poly-N-vinylcarbazole, polyvinyl butyral, styene-butadiene copolymer, and styrene-acrylonitrile copolymer.

The charge generating layer is formed on the intermediate layer by coating a dispersion of the above-mentioned components in the form of a film on the intermediate layer and drying the same, for example, with a thickness ranging from 0.05 μm to several μm. It is preferable that the content of the above-mentioned dyes and pigments in the charge generating layer be in the range of 60 wt.% to 100 wt.%.

When crystal selenium particles and arsenic selenide alloy particles are used, those particles are used in combination with a charge transporting type binder agent and/or a charge transporting type organic compound. Examples of such a charge transporting compound are polyvinyl carbazole and its derivatives (for example, carbazole derivatives comprising a carbazole skeleton having as a substituent a halogen such as chlorine and bromine, a methyl group and an amino group), polyvinyl pyrene, oxadiazole, pyrazoline, hydrazone, diarylmethane, α-phenyl stilbene, nitrogen-containing compounds such as triphenylamine derivatives, and diarylmethane derivatives. Of these compounds, polyvinyl carbazole and its derivatives are particularly preferable for use in the present invention. The above compounds can also be used in combination. Even in the case where the above compounds are used in combination, it is preferable to use polyvinyl carbazole or its derivatives in combination with other charge transporting type organic compounds. When necessary, for the purpose of improving the adhesiveness and flexibility of the charge generating layer, the binder agents employed in combination with the previously mentioned organic pigments and dyes can also employed in the charge generating layer.

It is preferable that the content of the charge generating materials in the charge generating layer be in the range of 30 to 90 wt.% of the entire weight of the charge generating layer. Further it is preferable that the thickness of the charge generating layer be in the range of 0.2 μm to 5 μm.

The charge transporting layer which is formed on the charge generating layer serves to hold the electric charges on the surface thereof, and, upon being exposed to light, to transport the electric charges which have been generated and separated in the charge generating layer so as to combine the held electric charges. For the purpose of holding the electric charges, it is required that the electric resistivity of the photoconductive layer be high, and for the purpose of attaining a high surface potential by the held electric charge, it is required that the dielectric constant be small and excellent in charge transportation. In order to satisfy these requirements, an organic charge transporting layer containing as an effective component an organic charge transporting material is employed. Examples of such an organic charge transporting material are conventionally known compounds such as poly-N-vinylcarbazole compounds, pryazoline compounds, α-phenystilbene compounds, hydrazone compounds, diarylmethane compounds, triphenylamine compounds, divinylbenzene compounds, fluorene compounds, anthrancene compounds, oxadiazole compounds, and diaminocarbazole compounds. The organic charge transporting materials other than poly-N-vinylcarbazole compounds can be used by dispersing them in a resin such as polycarbonate as in the case of the charge generating layer. However, it is not always necessary to use the same resin in both the charge generating layer and the charge transporting layer.

When necessary, a plasticizer may be added to the charge transporting layer. Examples of such a plasticizer are halognetated paraffin, dimethylnaphthalene, dibutyl phthalate, dioctyl phthalate, tricresyl phosphate, polymers such as polyester and copolymers.

The charge transporting layer can be formed on the charge generating layer, with a thickness of 5 μm to 100 μm, for example, by the steps of (i) dissolving in an organic solvent a charge generating material, any of the above-mentioned binder resins, and a silicone oil serving as a levelling agent at the time of coating the charge transporting layer on the charge generating layer to form a solution, (ii) coating the solution on the charge generating layer and (iii) drying the same. In this case, it is preferable that the content ratio of the charge transporting material to the binder resin to 2:8 to 8 to 2, and the content of the binder resin relative to the silicone oil be in the range of 0.001 wt.% to 1 wt.%.

EXAMPLE 1-1

Preparation of Intermediate Layer Coating Liquid

A mixture of the following components was dispersed, whereby an intermediate layer coating liquid was prepared:

| | Parts by Weight |
|---|---|
| n-stearyl alcohol | 4 |
| Nylon resin (Trademark "CM-8000" made by Toray Industries, Inc.) | 4 |
| Methanol | 60 |
| Butanol | 32 |

Preparation of Charge Generating Layer Coating Liquid

In a glass pot having a diameter of 15 cm, stainless balls having a diameter of 1 cm were placed up to a half of the pot. Further, 400 g of cyclohexanone and 25 g of Azo Pigment No. 1 in Table 1 were placed in the glass pot and mixed for 48 hours. To this mixture, 400 g of cyclohexanone was further added, and the mixture was dispersed for 24 hours to prepare a dispersion. 800 g of methyl ethyl ketone was then added dropwise to 800 g of the dispersion with stirring, whereby a charge generating layer coating liquid was prepared.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material of the following formula: | 10 |

-continued

| | Parts by Weight |
|---|---|
| 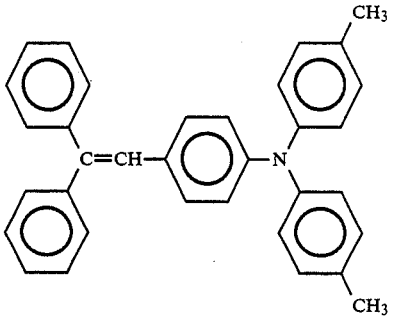 | |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries, Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 1-1 according to the present invention was prepared.

COMPARATIVE EXAMPLE 1-1

Example 1-1 was repeated except that the n-stearyl alcohol was eliminated from the formulation of the intermediate layer coating liquid in Example 1-1, whereby a comparative electrophotographic photoconductor No. 1-1was prepared.

EXAMPLE 1-2

Example 1-1 was repeated except that the intermediate layer coating liquid employed in Example 1-1 was replaced by an intermediate layer coating liquid with the following formulation, whereby an electrophotographic photoconductor No. 1-2 according to the present invention was prepared:

Formulation of Intermediate Layer Coating Liquid

| | Parts by Weight |
|---|---|
| n-stearyl alcohol | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 1-2

Example 1-2 was repeated except that the n-stearyl alcohol was eliminated from the formulation of the intermediate layer coating liquid in Example 1-2, whereby a comparative electrophotographic photoconductor No. 1-2 was prepared.

EXAMPLE 1-3

Example 1-1 was repeated except that the intermediate layer coating liquid employed in Example 1-1 was replaced by an intermediate layer coating liquid with the following formulation, whereby an electrophotographic photoconductor No. 1-3 according to the present invention was prepared:

Formulation of Intermediate Layer Coating Liquid

| | Parts by Weight |
|---|---|
| n-docosanol | 4 |
| Nylon resin (Trademark "CM-8000" made by Toray Industries, Inc.) | 4 |
| Methanol | 60 |
| Butanol | 32 |

EXAMPLE 1-4

Example 1-1 was repeated except that the α-phenylstilbene charge transporting material employed in Example 1-1 was replaced by the following charge transporting material, whereby an electrophotographic photoconductor No. 1-4 according to the present invention was prepared:

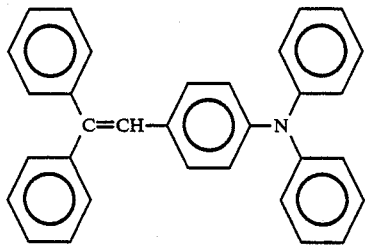

COMPARATIVE EXAMPLE 1-3

Example 1-4 was repeated except that the n-stearyl alcohol was eliminated from the formulation of the intermediate layer coating liquid, whereby a comparative electrophotographic photoconductor No. 1-3 was prepared.

EXAMPLE 1-5

Preparation of Intermediate Layer Coating Liquid

A mixture of the following components was dispersed in a ball mill for 72 hours:

| | Parts by Weight |
|---|---|
| n-stearyl alcohol | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again for 48 hours, whereby an intermediate layer coating liquid was prepared.

Example 1-1 was then repeated except that the intermediate layer coating liquid employed in Example 1-1 was replaced by the above prepared intermediate layer coating liquid, whereby an electrophotographic photoconductor No. 1-5 according to the present invention was prepared.

EXAMPLE 1-6

Preparation of Intermediate Layer Coating Liquid

A mixture of the following components was dispersed in a ball mill, whereby an intermediate layer coating liquid was prepared.

| | Parts by Weight |
|---|---|
| n-stearyl alcohol | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 1-1 was repeated except that the intermediate layer coating liquid employed in Example 1-1 was replaced by the above prepared intermediate layer coating liquid, and the intermediate layer coating liquid was coated on the PET film and subjected to a heat treatment at 130° C. for 1 hour, whereby an electrophotographic photoconductor No. 1-6 according to the present invention was prepared.

By use of a Paper Analyzer (Kawaguchi Electro Works, Model SP-428), each of the electrophotographic photoconductors No. 1-1~No. 1-6 and comparative photoconductors No. 1-1~No. 1-3 was negatively charged in the dark under application of −6 kV of corona charge for 20 seconds and was then allowed to stand in the dark without applying any charge thereto until the surface potential of the photoconductor became −800 V. At this moment, the photoconductor was illuminated by a tungsten lamp in such a manner that the illuminance on the illuminated surface of the photoconductor was 4.5 lux. In the above process, the surface potential V(Volts) of the photoconductor was measured 2 seconds after the initiation of the charging of the photoconductor by the corona charge, and the exposure S(lux sec) required for reducing the surface potential to −400 V by the light exposure was also measured.

Each of the above photoconductors was exposed to a light of 100,000 lux sec by use of a tungstem lamp with a color temperature of 2856° K. and was then subjected to the same charging and exposing process as mentioned above, so that the corresponding surface potential V' (V) and exposure S'(lux sec) of the photoconductor was measured. The results are shown in the following Table 2:

TABLE 2

| | Before Fatigue | | After Fatigue | |
|---|---|---|---|---|
| | V (Volts) | S (lux.sec) | V' (Volts) | S' (lux.sec) |
| Example 1-1 | −896 | 0.59 | −892 | 0.58 |
| Comp. Ex. 1-1 | −851 | 0.62 | −670 | 0.60 |
| Example 1-2 | −887 | 0.61 | −881 | 0.63 |
| Comp. Ex. 1-2 | −849 | 0.63 | −658 | 0.61 |

TABLE 2-continued

| | Before Fatigue | | After Fatigue | |
|---|---|---|---|---|
| | V (Volts) | S (lux.sec) | V' (Volts) | S' (lux.sec) |
| Example 1-3 | −832 | 0.63 | −830 | 0.64 |
| Example 1-4 | −840 | 0.62 | −835 | 0.65 |
| Comp. Ex. 1-3 | −793 | 0.66 | −590 | 0.63 |
| Example 1-5 | −821 | 0.60 | −806 | 0.62 |
| Example 1-6 | −807 | 0.64 | −805 | 0.66 |

EXAMPLE 1-7

The same intermediate layer coating liquid as that employed in Example 1-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed on the aluminum drum.

On the thus formed intermediate layer, the same charge generating layer coating liquid as that employed in Example 1-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 1-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 1-7 in the shape of a drum according to the present invention was prepared.

The thus prepared photoconductor drum was incorporated in a commercially available copying machine (Trademark "FT4060" made by Ricoh Company, Ltd.) which was modified in such a manner that the polarity of a charger for electrostatic latent image formation on the photoconductor, the polarity of a charger for image transfer, and the polarity of development bias voltage were all converted to a negative polarity. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −730 V.

COMPARATIVE EXAMPLE 1-4

By use of the same intermediate layer coating liquid, charge generating layer coating liquid and charge transporting coating liquid as those employed in Comparative Example 1-1, a photoconductor drum of the same type as that in Example 1-7 was prepared, whereby a comparative electrophotographic photoconductor No. 1-4 was prepared.

This comparative electrophotographic photoconductor No. 1-4 was subjected to the same tests for measuring the initial surface potential and the surface potential after repeating the cycle of charging and exposure 10,000 times. The result was that the surface potential was drastically decreased to −520 V after the 10,000 cycles and the image density was also decreased.

EXAMPLE 2-1

Preparation of Intermediate Layer Coating Liquid

A mixture of the following components was dispersed, whereby an intermediate layer coating liquid was prepared:

| | Parts by Weight |
|---|---|
| 1,12-dodecanediol | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 2-1 according to the present invention was prepared.

COMPARATIVE EXAMPLE 2-1

Example 1-1 was repeated except that the 1,12-dodecane-diol was eliminated from the formulation of the intermediate layer coating liquid in Example 2-1, whereby a comparative electrophotographic photoconductor No. 2-1 was prepared.

EXAMPLE 2-2

Example 2-1 was repeated except that the intermediate layer coating liquid employed in Example 1-1 was replaced by an intermediate layer coating liquid with the following formulation, whereby an electrophotographic photoconductor No. 2-2 according to the present invention was prepared:

Formulation of Intermediate Layer Coating Liquid

| | Parts by Weight |
|---|---|
| 1,12-dodecanediol | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 2-2

Example 2-2 was repeated except that the 1,12-dodecane-diol was eliminated from the formulation of the intermediate layer coating liquid in Example 2-2, whereby a comparative electrophotographic photoconductor No. 2-2 was prepared.

EXAMPLE 2-3

Example 2-1 was repeated except that the intermediate layer coating liquid employed in Example 2-1 was replaced by an intermediate layer coating liquid with the following formulation, whereby an electrophotographic photoconductor No. 2-3 according to the present invention was prepared:

Formulation of Intermediate Layer Coating Liquid

| | Parts by Weight |
|---|---|
| Propylene glycol | 4 |
| Nylon resin (Trademark "CM-8000" made by Toray Industries, Inc.) | 4 |
| Methanol | 60 |
| Butanol | 32 |

EXAMPLE 2-4

Example 2-1 was repeated except that the α-phenylstilbene charge transporting material employed in Example 2-1 was replaced by the following charge transporting material, whereby an electrophotographic photoconductor No. 2-4 according to the present invention was prepared:

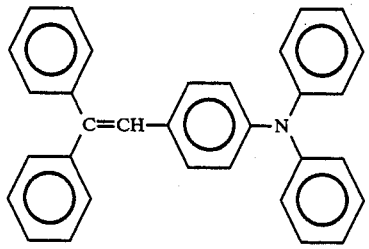

COMPARATIVE EXAMPLE 2-3

Example 2-4 was repeated except that the 1,12-dodecane-diol was eliminated from the formulation of the intermediate layer coating liquid in Example 2-4, whereby a comparative electrophotographic photoconductor No. 2-3 was prepared.

EXAMPLE 2-5

Preparation of Intermediate Layer Coating Liquid

A mixture of the following components was dispersed in a ball mill for 72 hours:

| | Parts by Weight |
|---|---|
| 1,12-dodecanediol | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again for 48 hours, whereby an intermediate layer coating liquid was prepared.

Example 2-1 was then repeated except that the intermediate layer coating liquid employed in Example 2-1 was replaced by the above prepared intermediate layer coating liquid, whereby an electrophotographic photoconductor No. 2-5 according to the present invention was prepared.

EXAMPLE 2-6

Preparation of Intermediate Layer Coating Liquid

A mixture of the following components was dispersed in a ball mill, whereby an intermediate layer coating liquid was prepared.

| | Parts by Weight |
|---|---|
| 1,12-dodecanediol | 48 |
| Polyvinyl butyral resin (Trademark "BL-1" made by Sekisui Chemical Co., Ltd.) | 48 |
| Tolylenediisocyanate | 14.5 |
| Finely-divided tin oxide particles | 48 |
| Cyclohexanone | 552 |
| Methyl ethyl ketone | 130 |

Example 2-1 was repeated except that the intermediate layer coating liquid employed in Example 2-1 was replaced by the above prepared intermediate layer coating liquid, and the intermediate laeyr coating liquid was coated on an Al-deposited PET film having a thickness of 100 μm and subjected to a heat treatment at 130° C. for 1 hour, whereby an electrophotographic photoconductor No. 2-6 according to the present invention was prepared.

The electrophotographic photoconductors No. 2-1~No. 2-6 and comparative photoconductors No. 2-1~No. 2-3 were subjected to the same charging and exposing tests as in Example 1-1. The results are shown in the following Table 3.

TABLE 3

| | Before Fatigue | | After Fatigue | |
|---|---|---|---|---|
| | V (Volts) | S (lux.sec) | V' (Volts) | S' (lux.sec) |
| Example 2-1 | −890 | 0.61 | −887 | 0.60 |
| Comp. Ex. 2-1 | −851 | 0.62 | −670 | 0.60 |
| Example 2-2 | −825 | 0.59 | −819 | 0.57 |
| Comp. Ex. 2-2 | −849 | 0.63 | −658 | 0.61 |
| Example 2-3 | −844 | 0.64 | −841 | 0.62 |
| Example 2-4 | −842 | 0.60 | −839 | 0.61 |
| Comp. Ex. 2-3 | −793 | 0.66 | −590 | 0.63 |
| Example 2-5 | −815 | 0.61 | −806 | 0.59 |
| Example 2-6 | −809 | 0.62 | −803 | 0.60 |

EXAMPLE 2-7

The same intermediate layer coating liquid as that employed in Example 2-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 2-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 2-1 was coated by immerse coating. The coated liquid was heated and dried at 130° C. for 20 minutes, whereby a charge transporting layer having a thickness of 20 μm was formed on the charge generating layer, whereby an electrophotographic photoconductor No. 2-7 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −750 V.

EXAMPLE 3-1

Preparation of Intermediate Layer Coating Liquid

A mixture of the following components was dispersed, whereby an intermediate layer coating liquid was prepared:

| | Parts by Weight |
|---|---|
| Polyethylene glycol (Trademark "PEG 6000S" made by Sanyo Chemical Industries, Ltd.) | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 3-1 according to the present invention was prepared.

COMPARATIVE EXAMPLE 3-1

Example 3-1 was repeated except that the polyethylene glycol was eliminated from the formulation of the intermediate layer coating liquid in Example 3-1, whereby a comparative electrophotographic photoconductor No. 3-1 was prepared.

EXAMPLE 3-2

Example 3-1 was repeated except that the intermediate layer coating liquid employed in Example 3-1 was replaced by an intermediate layer coating liquid with the following formulation, whereby an electrophotographic photoconductor No. 3-2 according to the present invention was prepared:

Formulation of Intermediate Layer Coating Liquid

| | Parts by Weight |
|---|---|
| Polyethylene glycol (Trademark "PEG 6000S" made by Sanyo Chemical Industries, Ltd.) | 4 |
| Polyvinyl alcohol (Trademark | 4 |

-continued

| | Parts by Weight |
|---|---|
| "Poval B-24" made by Denki Kagaku Kogyo K.K.) | |
| Finely-divided tin oxide particles | 48 |
| Methanol | 41 |
| Water | 41 |

COMPARATIVE EXAMPLE 3-2

Example 3-2 was repeated except that the polyethylene glycol was eliminated from the formulation of the intermediate layer coating liquid in Example 3-2, whereby a comparative electrophotographic photoconductor No. 3-2 was prepared.

EXAMPLE 3-3

Example 3-1 was repeated except that the intermediate layer coating liquid employed in Example 3-1 was replaced by an intermediate layer coating liquid with the following formulation, whereby an electrophotographic photoconductor No. 3-3 according to the present invention was prepared:

Formulation of Intermediate Layer Coating Liquid

| | Parts by Weight |
|---|---|
| Polyethylene glycol (Trademark "PEO-1" made by Seitetsu Kagaku Co, Ltd.) | 0.5 |
| Nylon resin (Trademark "CM-8000" made by Toray Industries, Inc.) | 7.5 |
| Methanol | 60 |
| Butanol | 32 |

EXAMPLE 3-4

Example 3-1 was repeated except that the charge generating material (Pigment No. 1 in Table 1) employed in Example 3-1 was replaced by Pigment No. 47 in Table 1, whereby an electrophotographic photoconductor No. 3-4 according to the present invention was prepared.

COMPARATIVE EXAMPLE 3-3

Example 3-4 was repeated except that the polyethylene glycol was eliminated from the formulation of the intermediate layer coating liquid in Example 3-4, whereby a comparative electrophotographic photoconductor No. 3-4 was prepared.

EXAMPLE 3-5

Example 3-4 was repeated except that the α-phenylstilbene type charge transporting material employed in Example 3-4 was replaced by the following charge transporting material, whereby an electrophotographic photoconductor No. 3-5 according to the present invention was prepared.

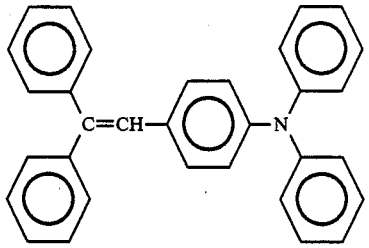

COMPARATIVE EXAMPLE 3-4

Example 3-5 was repeated except that the polyethylene glycol was eliminated from the formulation of the intermediate layer in Example 3-5, whereby a comparative electrophotographic photoconductive No. 3-4 was prepared.

EXAMPLE 3-6

Example 3-4 was repeated except that the polyethylene glycol (Trademark "PEG 6000S" made by Sanyo Chemical Industries, Ltd.) employed in Example 3-4 was replaced by polyethylene glycol (Trademark "PEG 200" made by Sanyo Chemical Industries, Ltd.), whereby an electrophotographic photoconductor No. 3-6 according to the present invention was prepared.

EXAMPLE 3-7

Preparation of Intermediate Layer Coating Liquid

A mixture of the following components was dispersed in a ball mill for 72 hours:

| | Parts by Weight |
|---|---|
| Polyethylene glycol (Trademark "PEG 6000S" made by Sanyo Chemical Industries, Ltd.) | 5 |
| Nylon resin (Trademark "CM-8000" made by Toray Industries, Inc.) | |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 3-1 was then repeated except that the intermediate layer coating liquid employed in Example 3-1 was replaced by the above prepared intermediate layer coating liquid, whereby an electrophotographic photoconductor No. 3-7 according to the present invention was prepared.

EXAMPLE 3-8

Preparation of Intermediate Layer Coating Liquid

A mixture of the following components was dispersed in a ball mill, whereby an intermediate layer coating liquid was prepared.

| | Parts by Weight |
|---|---|
| Polyethylene glycol (Trademark "PEG 6000S" made by Sanyo Chemical Industries, Ltd.) | 48 |
| Polyvinyl butyral resin | 48 |

-continued

| | Parts by Weight |
|---|---|
| (Trademark "BL-1" made by Sekisui Chemical Co., Ltd.) | |
| Finely-divided tin oxide particles | 48 |
| Tolylenediisocyanate | 14.5 |
| Cyclohexanone | 552 |
| Methyl ethyl ketone | 130 |

Example 3-1 was repeated except that the intermediate layer coating liquid employed in Example 3-1 was replaced by the above prepared intermediate layer coating liquid, and the intermediate layer coating liquid was coated on the PET film and subjected to a heat treatment at 130° C. for 1 hour, whereby an electrophotographic photoconductor No. 3-8 according to the present invention was prepared.

The electrophotographic photoconductors No. 3-1~No. 3-8 and comparative photoconductors No. 3-1~No. 3-3 were subjected to the same charging and exposing tests as in Example 1-1. The results are shown in the following Table 4

TABLE 4

| | Before Fatigue | | After Fatigue | |
|---|---|---|---|---|
| | V (Volts) | S (lux · sec) | V' (Volts) | S' (lux · sec) |
| Example 3-1 | −898 | 1.16 | −897 | 1.16 |
| Comp. Ex. 3-1 | −851 | 1.01 | −670 | 0.99 |
| Example 3-2 | −891 | 1.09 | −889 | 1.07 |
| Comp. Ex. 3-2 | −849 | 1.03 | −658 | 1.00 |
| Example 3-3 | −918 | 1.19 | −919 | 1.15 |
| Example 3-4 | −925 | 1.21 | −889 | 1.09 |
| Comp. Ex. 3-3 | −792 | 0.92 | −593 | 0.89 |
| Example 3-5 | −911 | 1.13 | −883 | 1.07 |
| Comp. Ex. 3-4 | −789 | 0.90 | −566 | 0.85 |
| Example 3-6 | −892 | 1.08 | −873 | 1.06 |
| Example 3-7 | −893 | 1.10 | −893 | 1.09 |
| Example 3-8 | −889 | 1.07 | −882 | 1.05 |

EXAMPLE 3-9

The same intermediate layer coating liquid as that employed in Example 3-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 3-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 3-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 3-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −750 V.

EXAMPLE 4-1

Preparation of Intermediate Layer Coating Liquid

A mixture of the following components was dispersed, whereby an intermediate layer coating liquid was prepared:

| | Parts by Weight |
|---|---|
| Polypropylene glycol (Average molecular weight: 4000 made by Wako Pure Chemical Industries, Ltd.) | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 4-1 according to the present invention was prepared.

COMPARATIVE EXAMPLE 4-1

Example 4-1 was repeated except that the polypropylene glycol was eliminated from the formulation of the intermediate layer coating liquid in Example 4-1, whereby a comparative electrophotographic photoconductor No. 4-1 was prepared.

EXAMPLE 4-2

Example 4-1 was repeated except that the intermediate layer coating liquid employed in Example 4-1 was replaced by an intermediate layer coating liquid with the following formulation, whereby an electrophotographic photoconductor No. 4-2 according to the present invention was prepared:

Formulation of Intermediate Layer Coating Liquid

| | Parts by Weight |
|---|---|
| Polypropylene glycol (Average molecular weight, 4000: made by Wako Pure Chemical Industries, Ltd.) | 4 |
| Polyvinyl alcohol (Trademark "Poval B-24" made by Denki Kagaku Kogyo K. K.) | 4 |
| Methanol | 41 |
| Water | 41 |

COMPARATIVE EXAMPLE 4-2

Example 4-2 was repeated except that the polypropylene glycol was eliminated from the formulation of the intermediate layer coating liquid in Example 4-2, whereby a comparative electrophotographic photoconductor No. 4-2 was prepared.

EXAMPLE 4-3

Example 4-1 was repeated except that the intermediate layer coating liquid employed in Example 4-1 was replaced by an intermediate layer coating liquid with the following formulation, whereby an electrophotographic photoconductor No. 4-3 according to the present invention was prepared:

Formulation of Intermediate Layer Coating Liquid

| | Parts by Weight |
|---|---|
| Polypropylene glycol (Average molecular weight: 1000, made by Wako Pure Chemical Industries, Ltd.) | 4 |
| Nylon resin (Trademark "CM-8000" made by Toray Industries, Inc.) | 4 |
| Methanol | 60 |
| Butanol | 32 |

EXAMPLE 4-4

Example 4-1 was repeated except that the charge generating material (Pigment No. 1 in Table 1) employed in Example 3-1 was replaced by Pigment No. 47 in Table 1, whereby an electrophotographic photoconductor No. 4-4 according to the present invention was prepared.

COMPARATIVE EXAMPLE 4-3

Example 4-4 was repeated except that the polypropylene glycol was eliminated from the formulation of the intermediate layer coating liquid in Example 4-4, whereby a comparative electrophotographic photoconductor No. 4-4 was prepared.

EXAMPLE 4-5

Example 4-4 was repeated except that the α-phenylstilbene type charge transporting material employed in Example 4-4 was replaced by the following charge transporting material, whereby an electrophotographic photoconductor No. 4-5 according to the present invention was prepared.

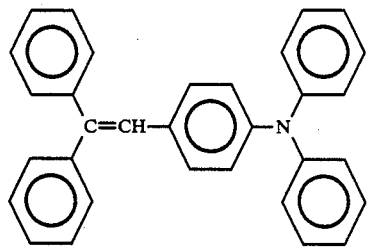

COMPARATIVE EXAMPLE 4-4

Example 4-5 was repeated except that the polypropylene glycol was eliminated from the formulation of the intermediate layer in Example 4-5, whereby a comparative electrophotographic photoconductor No. 4-4 was prepared.

EXAMPLE 4-6

Example 4-4 was repeated except that the polypropylene glycol (Average molecular weight: 4000, made by Wako Pure Chemical Industries, Ltd.) employed in Example 4-4 was replaced by polypropylene glycol (Average molecular weight: 3000, made by Wako Pure Chemical Industries, Ltd.), whereby an electrophotographic photoconductor No. 4-6 according to the present invention was prepared.

EXAMPLE 4-7

Preparation of Intermediate Layer Coating Liquid

A mixture of the following components was dispersed in a ball mill for 72 hours:

| | Parts by Weight |
|---|---|
| Polyproylene glycol (Average molecular weight: 4000, made by Wako Pure Chemical Industries, Ltd.) | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 4-1 was then repeated except that the intermediate layer coating liquid employed in Example 4-1 was replaced by the above prepared intermediate layer coating liquid, whereby an electrophotographic photoconductor No. 4-7 according to the present invention was prepared.

EXAMPLE 4-8

Preparation of Intermediate Layer Coating Liquid

A mixture of the following components was dispersed in a ball mill, whereby an intermediate layer coating liquid was prepared.

| | Parts by Weight |
|---|---|
| Polypropylene glycol (Average molecular weight: 4000, made by Wako Pure Chemical Industries, Ltd.) | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 4-1 was repeated except that the intermediate layer coating liquid employed in Example 4-1 was replaced by the above prepared intermediate layer coating liquid, and the intermediate layer coating liquid was coated on the PET film and subjected to a heat treatment at 130° C. for 1 hour, whereby an electrophotographic photoconductor No. 4-8 according to the present invention was prepared.

The electrophotographic photoconductors No. 4-1~No. 4-8 and comparative photoconductors No. 4-1~No. 4-3 were subjected to the same charging and exposing tests as in Example 1-1. The results are shown in the following Table 5:

TABLE 5

| | Before Fatigue | | After Fatigue | |
|---|---|---|---|---|
| | V (Volts) | S (lux · sec) | V' (Volts) | S' (lux · sec) |
| Example 4-1 | −902 | 0.59 | −905 | 0.58 |
| Comp. Ex. 4-1 | −851 | 0.61 | −670 | 0.60 |
| Example 4-2 | −893 | 0.61 | −890 | 0.61 |
| Comp. Ex. 4-2 | −849 | 0.62 | −658 | 0.61 |
| Example 4-3 | −882 | 0.63 | −880 | 0.62 |
| Example 4-4 | −891 | 0.45 | −890 | 0.43 |
| Comp. Ex. 4-3 | −792 | 0.43 | −593 | 0.42 |
| Example 4-5 | −888 | 0.77 | −886 | 0.74 |
| Comp. Ex. 4-4 | −789 | 0.45 | −566 | 0.45 |
| Example 4-6 | −861 | 0.42 | −863 | 0.41 |
| Example 4-7 | −870 | 0.63 | −875 | 0.62 |
| Example 4-8 | −889 | 0.65 | −885 | 0.64 |

EXAMPLE 4-9

The same intermediate layer coating liquid as that employed in Example 4-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 4-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 4-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 4-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passes under the charger for image formation was measured. The result was −800 V. The cycle of the charging and exposure was repeated 10,000 times and copies were made in the same manner as mentioned above. The result was that the image density was not decreased at all and the surface potential of the photoconductor was −780 V.

EXAMPLE 5-1

Preparation of Intermediate Layer Coating Liquid

A mixture of the following components was dispersed, whereby an intermediate layer coating liquid was prepared:

| | Parts by Weight |
|---|---|
| Polybutylene glycol (Trademark "Terathane T2900" made by Du Pont de Nemours, E. I. & Co., Average number of added moles: n ≈ 40~50) | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120' C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 5-1 according to the present invention was prepared.

COMPARATIVE EXAMPLE 5-1

Example 4-1 was repeated except that the polybutylene glycol was eliminated from the formulation of the intermediate layer coating liquid in Example 5-1, whereby a comparative electrophotographic photoconductor No. 5-1 was prepared.

EXAMPLE 5-2

Example 5-1 was repeated except that the intermediate layer coating liquid employed in Example 5-1 was replaced by an intermediate layer coating liquid with the following formulation, whereby an electrophotographic photoconductor No. 5-2 according to the present invention was prepared:

Formulation of Intermediate Layer Coating Liquid

| | Parts by Weight |
|---|---|
| Polybutylene glycol (Trademark "Terathane T2900" made by Du Pont) | 4 |
| Polyvinyl alcohol (Trademark "Poval B-24" made by Denki Kagaku Kogyo K. K.) | 4 |
| Methanol | 41 |
| Water | 41 |

COMPARATIVE EXAMPLE 5-2

Example 5-2 was repeated except that the polybutylene glycol was eliminated from the formulation of the intermediate layer coating liquid in Example 5-2, whereby a comparative electrophotographic photoconductor No. 5-2 was prepared.

EXAMPLE 5-3

Example 5-1 was repeated except that the intermediate layer coating liquid employed in Example 5-1 was replaced by an intermediate layer coating liquid with the following formulation, whereby an electrophotographic photoconductor No. 5-3 according to the present invention was prepared:

Formulation of Intermediate Layer Coating Liquid

| | Parts by Weight |
|---|---|
| Polybutylene glycol (Trademark "Terathane T2900" made by Du Pont, Average number of | 4 |

-continued

| | Parts by Weight |
|---|---|
| added moles: n ≈ 8) | |
| Nylon resin (Trademark "CM-8000" made by Toray Industries, Inc.) | 4 |
| Methanol | 60 |
| Butanol | 32 |

EXAMPLE 5-4

Example 5-1 was repeated except that the charge generating material (Pigment No. 1 in Table 1) employed in Example 5-1 was replaced by Pigment No. 47 in Table 1, whereby an electrophotographic photoconductor No. 5-4 according to the present invention was prepared.

COMPARATIVE EXAMPLE 5-3

Example 5-4 was repeated except that the polybutylene glycol was eliminated from the formulation of the intermediate layer coating liquid in Example 5-4, whereby a comparative electrophotographic photoconductor No. 5-3 was prepared.

EXAMPLE 5-5

Example 5-4 wwas repeated except that the α-phenylstilbene type charge transporting material employed in Example 5-4 was replaced by the following charge transporting material, whereby an electrophotographic photoconductor No. 5-5 according to the present invention was prepared.

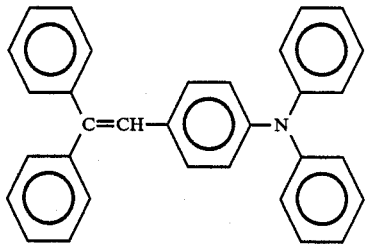

COMPARATIVE EXAMPLE 5-4

Example 5-5 was repeated except that the polybutylene glycol was eliminated from the formulation of the intermediate layer in Example 5-5, whereby a comparative electrophotographic photoconductor No. 5-4 was prepared.

EXAMPLE 5-6

Example 5-4 was repeated except that the polybutylene glycol (Trademark "Terathane T2900" made by Du Pont) employed in Example 5-4 was replaced by polybutylene glycol (Trademark "Terathane T650" made by Du Pont), whereby an electrophotographic photoconductor No. 5-6 according to the present invention was prepared.

EXAMPLE 5-7

Preparation of Intermediate Layer Coating Liquid

A mixture of the following components was dispersed in a ball mill for 72 hours:

| | Parts by Weight |
|---|---|
| Polybutylene glycol (Trademark "Terathaen T2900" made by Du Pont) | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 5-1 was then repeated except that the intermediate layer coating liquid employed in Example 5-1 was replaced by the above prepared intermediate layer coating liquid, whereby an electrophotographic photoconductor No. 5-7 according to the present invention was prepared.

EXAMPLE 5-8

Preparation of Intermediate Layer Coating Liquid

A mixture of the following components was dispersed in a ball mill, whereby an intermediate layer coating liquid was prepared.

| | Parts by Weight |
|---|---|
| Polybutylene glycol (Trademark "Terathane T2900" made by Du Pont) | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 5-1 was repeated except that the intermediate layer coating liquid employed in Example 5-1 was replaced by the above prepared intermediate layer coating liquid, and the intermediate layer coating liquid was coated on the PET film and subjected to a heat treatment at 130° C. for 1 hour, whereby an electrophotographic photoconductor No. 5-8 according to the present invention was prepared.

The electrophotographic photoconductors No. 5-1~No. 5-8 and comparative photoconductors No. 5-1~No. 5-3 were subjected to the same charging and exposing tests as in Example 1-1. The results are shown in the following Table 6:

TABLE 6

| | Before Fatigue | | After Fatigue | |
|---|---|---|---|---|
| | V (Volts) | S (lux · sec) | V' (Volts) | S' (lux · sec) |
| Example 5-1 | −906 | 0.58 | −903 | 0.56 |
| Comp. Ex. 5-1 | −851 | 0.61 | −670 | 0.60 |
| Example 5-2 | −900 | 0.64 | −898 | 0.62 |
| Comp. Ex. 5-2 | −849 | 0.62 | −658 | 0.61 |
| Example 5-3 | −890 | 0.65 | −895 | 0.62 |
| Example 5-4 | −893 | 0.42 | −889 | 0.41 |
| Comp. Ex. 5-3 | −792 | 0.43 | −593 | 0.42 |
| Example 5-5 | −872 | 0.71 | −870 | 0.70 |
| Comp. Ex. 5-4 | −789 | 0.45 | −566 | 0.45 |
| Example 5-6 | −885 | 0.43 | −862 | 0.43 |
| Example 5-7 | −841 | 0.64 | −845 | 0.65 |
| Example 5-8 | −873 | 0.61 | −871 | 0.62 |

EXAMPLE 5-9

The same intermediate layer coating liquid as that employed in Example 5-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 5-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 5-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 5-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −790 V.

EXAMPLE 6-1

Preparation of Intermediate Layer Coating Liquid

A mixture of the following components was dispersed, whereby an intermediate layer coating liquid was prepared:

| | Parts by Weight |
|---|---|
| Polyethylene glycol monostearate (Trademark "Ionet MS400": n = 9, made by Sanyo Chemical Industries, Ltd.) | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 6-1 according to the present invention was prepared.

COMPARATIVE EXAMPLE 6-1

Example 6-1 was repeated except that the polyethylene glycol monostearate was eliminated from the formulation of the intermediate layer coating liquid in Example 6-1, whereby a comparative electrophotographic photoconductor No. 6-1 was prepared.

EXAMPLE 6-2

Example 6-1 was repeated except that the intermediate layer coating liquid employed in Example 6-1 was replaced by an intermediate layer coating liquid with the following formulation, whereby an electrophotographic photoconductor No. 6-2 according to the present invention was prepared:

Formulation of Intermediate Layer Coating Liquid

| | Parts by Weight |
|---|---|
| Polybutylene glycol monostearate (Trademark "Ionet MS400":m = 9, made by Sanyo Chemical Industries, Ltd.) | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 6-2

Example 6-2 was repeated except that the polyethylene glycol monostearate was eliminated from the formulation of the intermediate layer coating liquid in Example 6-2, whereby a comparative electrophotographic photoconductor No. 6-2 was prepared.

EXAMPLE 6-3

Example 6-1 was repeated except that the intermediate layer coating liquid employed in Example 6-1 was replaced by an intermediate layer coating liquid with the following formulation, whereby an electrophotographic photoconductor No. 6-3 according to the present invention was prepared:

Formulation of Intermediate Layer Coating Liquid

| | Parts by Weight |
|---|---|
| Polyethylene glycol distearate (Trademark "Ionet DS 400":n = 9, made by Sanyo Chemical Industries, Ltd.) | 4 |
| Nylon resin (Trademark "CM-8000" made by Toray Industries, Inc.) | 4 |
| Methanol | 60 |
| Butanol | 32 |

EXAMPLE 6-4

Example 6-1 was repeated except that the charge generating material (Pigment No. 1 in Table 1) employed in Example 5-1 was replaced by Pigment No. 47 in Table 1, whereby an electrophotographic photoconductor No. 6-4 according to the present invention was prepared.

COMPARATIVE EXAMPLE 6-3

Example 6-4 was repeated except that the polyethylene glycol monostearate was eliminated from the formulation of the intermediate layer coating liquid in Example 6-4, whereby a comparative electrophotographic photoconductor No. 6-3 was prepared.

EXAMPLE 6-5

Example 6-4 was repeated except that the α-phenylstilbene type charge transporting material employed in Example 6-4 was replaced by the following charge transporting material, whereby an electrophotographic photoconductor No. 6-5 according to the present invention was prepared.

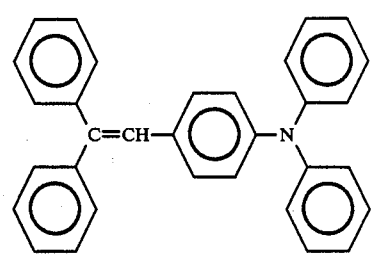

COMPARATIVE EXAMPLE 6-4

Example 6-5 was repeated except that the polyethylene glycol monostearate was eliminated from the formulation of the intermediate layer in Example 6-5, whereby a comparative electrophotographic photoconductor No. 6-4 was prepared.

EXAMPLE 6-6

Example 6-4 was repeated except that the polyethylene glycol monostearate. (Trademark "Ionet MS40": n=9, made by Sanyo Chemical Industries, Ltd.) employed in Example 6-4 was replaced by polyethylene glycol monostearate (Trademark "Ionet MS 1000": n=23, made by Sanyo Chemical Industries, Ltd.), whereby an electrophotographic photoconductor No. 6-6 according to the present invention was prepared.

EXAMPLE 6-7

Preparation of Intermediate Layer Coating Liquid

A mixture of the following components was dispersed in a ball mill for 72 hours:

| | Parts by Weight |
|---|---|
| Polyethylene glycol monostearate (Trademark "Ionet MS400":n = 9, made by Sanyo Chemical Industries, Ltd.) | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 6-1 was then repeated except that the intermediate layer coating liquid employed in Example 6-1 was replaced by the above prepared intermediate layer coating liquid, whereby an electrophotographic photoconductor No. 6-7 according to the present invention was prepared.

EXAMPLE 6-8

Preparation of Intermediate Layer Coating Liquid

A mixture of the following components was dispersed in a ball mill, whereby an intermediate layer coating liquid was prepared.

| | Parts by Weight |
|---|---|
| Polyethylene glycol monostearate (Trademark "Ionet MS 400": n = 9, made by Sanyo Chemical Industries, Ltd.) | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 6-1 was repeated except that the intermediate layer coating liquid employed in Example 6-1 was replaced by the above prepared intermediate layer coating liquid, which was coated on the PET film and subjected to a heat treatment at 130° C. for 1 hour, whereby an electrophotographic photoconductor No. 6-8 according to the present invention was prepared.

The electrophotographic photoconductors No. 6-1~No. 6-8 and comparative photoconductors No. 6-1~No. 6-3 were subjected to the same charging and exposing tests as in Example 1-1. The results are shown in the following Table 7:

TABLE 7

| | Before Fatigue | | After Fatique | |
|---|---|---|---|---|
| | V (Volts) | S (lux.sec) | V' (Volts) | S' (lux.sec) |
| Example 6-1 | −891 | 0.58 | −879 | 0.57 |
| Comp. Ex. 6-1 | −851 | 0.61 | −670 | 0.60 |
| Example 6-2 | −903 | 0.63 | −900 | 0.64 |
| Comp. Ex.6-2 | −849 | 0.62 | −658 | 0.61 |
| Example 6-3 | −896 | 0.59 | −888 | 0.60 |
| Example 6-4 | −905 | 0.40 | −902 | 0.41 |
| Comp. Ex. 6-3 | −792 | 0.43 | −593 | 0.42 |
| Example 6-5 | −854 | 0.72 | −844 | 0.70 |
| Comp. Ex. 6-4 | −789 | 0.45 | −566 | 0.45 |
| Example 6-6 | −880 | 0.39 | −870 | 0.41 |
| Example 6-7 | −840 | 0.61 | −842 | 0.63 |
| Example 6-8 | −891 | 0.64 | −895 | 0.62 |

EXAMPLE 6-9

The same intermediate layer coating liquid so that employed in Example 6-1 was coated on the external surface of an aluminum drum with a wall thickness of 3 mm, a diameter of 80 mm and a length of 340 mm by immerse coating and was then heated and dried at 130° C. for 20 minutes, whereby an intermediate layers having a thickness of 1 μm was formed.

On the thus formed intermediate layer, the same charge generating layer coating liquid as that employed in Example 5-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as the employed in Example 6-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 6-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −740 V.

EXAMPLE 7-1

Preparation of Intermediate Layer Coating Liquid

A mixture of the following components was dispersed, whereby an intermediate layer coating liquid was prepared:

| | Parts by Weight |
|---|---|
| Polyethylene glycol monododecyl ether | 4 |

-continued

| | Parts by Weight |
|---|---|
| (Trademark "Emulmin L380": n = 38, made by Sanyo Chemical Industries, Ltd.) | |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liqid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120 C. for 20 minutes, whereby a charge transporting layer having a thickness of 20 μm was formed on the charge generating layer. Thus, an electrophotographic photoconductor No. 7-1 according to the present invention was prepared.

COMPARATIVE EXAMPLE 7-1

Example 7-1 was repeated except that the polyethylene glycol monododecyl ether was eliminated from the formulation of the intermediate layer coating liquid in Example 7-1, whereby a comparative electrophotographic photoconductor No. 7-1 was prepared.

EXAMPLE 7-2

Example 7-1 was repeated except that the intermediate layer coating liquid employed in Example 7-1 was replaced by an intermediate layer coating liquid with the following formulation, whereby an electrophotographic photoconductor No. 7-2 according to the present invention was prepared:

Formulation of Intermediate Layer Coating Liquid

| | Parts by Weight |
|---|---|
| Polyethylene glycol monododecyl ether (Trademark "Emulmin L380": n = 38, made by Sanyo Chemical Industries, Ltd.) | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 7-2

Example 7-2 was repeated except that the polyethylene glycol monododecyl ether was eliminated from the formulation of the intermediate layer coating liquid in Example 7-2, whereby a comparative electrophotographic photoconductor No. 7-2 was prepared.

EXAMPLE 7-3

Example 7-1 was repeated except that the intermediate layer coating liquid employed in Example 7-1 was replaced by an intermediate layer coating liquid with the following formulation, whereby an electrophotographic photoconductor No. 7-3 according to the present invention was prepared:

Formulation of Intermediate Layer Coating Liquid

| | Parts by Weight |
|---|---|
| Polyethylene glycol mono-nonylphenyl ether (Trademark "Nonipol 700": n = 70, made by Sanyo Chemical Industries, Ltd.) | 4 |
| Nylon resin (Trademark "CM-8000" made by Toray Industries, Inc.) | 4 |
| Methanol | 60 |
| Butanol | 32 |

EXAMPLE 7-4

Example 7-1 was repeated except that the charge generating material (Pigment No. 1 in Table 1) employed in Example 5-1 was replaced by Pigment No. 47 in Table 1, whereby an electrophotographic photoconductor No. 7-4 according to the present invention was prepared.

COMPARATIVE EXAMPLE 7-3

Example 7-4 was repeated except that the polyethylene glycol monostearate was eliminated from the formulation of the intermediate layer coating liquid in Example 7-4, whereby a comparative electrophotographic photoconductor No. 7-3 was prepared.

EXAMPLE 7-5

Example 7-4 was repeated except that the α-phenylstilbene type charge transporting material employed in Example 7-4 was replaced by the following charge transporting material, whereby an electrophotographic photoconductor No. 7-5 according to the present invention was prepared.

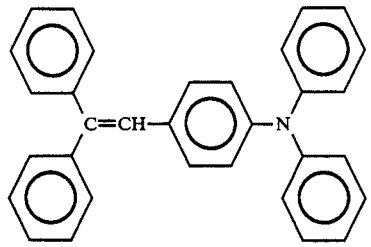

COMPARATIVE EXAMPLE 7-4

Example 7-5 was repeated except that the polyethylene glycol monododecyl ether was eliminated from the formulation of the intermediate layer in Example 7-5, whereby a comparative electrophotographic photoconductor No. 7-4 was prepared.

EXAMPLE 7-6

Example 7-4 was repeated except that the intermediate layer coating liquid employed in Example 7-4 was replaced by 5 parts by weight of polyethylene glycol monododecyl ether (Trademark "Emulmin L380": n=38, made by Sanyo Chemical Industries, Ltd.) and 95 parts by weight of ethanol, whereby an electrophotographic photoconductor No. 7-6 according to the present invention was prepared.

EXAMPLE 7-7

Preparation of Intermediate Layer Coating Liquid

A mixture of the following components was dispersed in a ball mill for 72 hours:

| | Parts by Weight |
|---|---|
| Polyethylene glycol monododecyl ether (Trademark "Emulmin L380": n = 38, made by Sanyo Chemical Industries, Ltd.) | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 7-1 was then repeated except that the intermediate layer coating liquid employed in Example 7-1 was replaced by the above prepared intermediate layer coating liquid, whereby an electrophotographic photoconductor No. 7-7 according to the present invention was prepared.

EXAMPLE 7-8

Preparation of Intermediate Layer Coating Liquid

A mixture of the following components was dispersed in a ball mill, whereby an intermediate layer coating liquid was prepared.

-continued

| | Parts by Weight |
|---|---|
| Polyethylene glycol monododecyl ether (Trademark "Emulmin L380": n = 38, made by Sanyo Chemical Industries, Ltd.) | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 7-1 was repeated except that the intermediate layer coating liquid employed in Example 7-1 was replaced by the above prepared intermediate layer coating liquid, and the intermediate layer coating liquid was coated on the PET film and subjected to a heat treatment at 130° C. for 1 hour, whereby an electrophotographic photoconductor No. 7-8 according to the present invention was prepared.

The electrophotographic photoconductors No. 7-1~No. 7-8 and comparative photoconductors No. 7-1~No. 7-3 were subjected to the same charging and exposing tests as in Example 1-1. The results are shown in the following Table 8:

TABLE 8

| | Before Fatigue | | After Fatigue | |
|---|---|---|---|---|
| | V (Volts) | S (lux.sec) | V' (Volts) | S' (lux.sec) |
| Example 7-1 | −892 | 0.58 | −890 | 0.57 |
| Comp. Ex. 7-1 | −851 | 0.61 | −670 | 0.60 |
| Example 7-2 | −887 | 0.62 | −882 | 0.61 |
| Comp. Ex. 7-2 | −849 | 0.62 | −658 | 0.61 |
| Example 7-3 | −852 | 0.63 | −860 | 0.60 |
| Example 7-4 | −880 | 0.42 | −872 | 0.41 |
| Comp. Ex. 7-3 | −792 | 0.43 | −593 | 0.42 |
| Example 7-5 | −835 | 0.78 | −832 | 0.73 |
| Comp. Ex. 7-4 | −789 | 0.45 | −566 | 0.45 |
| Example 7-6 | −873 | 0.46 | −870 | 0.44 |
| Example 7-7 | −893 | 0.63 | −887 | 0.61 |
| Example 7-8 | −895 | 0.65 | −893 | 0.66 |

EXAMPLE 7-9

The same intermediate layer coating liquid as that employed in Example 7-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 7-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 6-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 7-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −770 V.

EXAMPLE 8-1

Preparation of Intermediate Layer Coating Liquid

A mixture of the following components was dispersed, whereby an intermediate layer coating liquid was prepared:

| | Parts by Weight |
|---|---|
| Dibenzo-18-crown-6-ether | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 8-1 according to the present invention was prepared.

COMPARATIVE EXAMPLE 8-1

Example 8-1 was repeated except that the dibenzo-18-crown-6-ether was eliminated from the formulation of the intermediate layer coating liquid in Example 8-1, whereby a comparative electrophotographic photoconductor No. 8-1 was prepared.

EXAMPLE 8-2

Example 8-1 was repeated except that the intermediate layer coating liquid employed in Example 8-1 was replaced by an intermediate layer coating liquid with the following formulation, whereby an electrophotographic photoconductor No. 8-2 according to the present invention was prepared:

Formulation of Intermediate Layer Coating Liquid

| | Parts by Weight |
|---|---|
| Dibenzo-18-crown-6-ether | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 8-2

Example 8-2 was repeated except that the dibenzo-18-crown-6-ether was eliminated from the formulation of the intermediate layer coating liquid in Example 8-2, whereby a comparative electrophotographic photoconductor No. 8-2 was prepared.

EXAMPLE 8-3

Example 8-1 was repeated except that the intermediate layer coating liquid employed in Example 8-1 was replaced by an intermediate layer coating liquid with the following formulation, whereby an electrophotographic photoconductor No. 8-3 according to the present invention was prepared:

Formulation of Intermediate Layer Coating Liquid

| | Parts by Weight |
|---|---|
| 24-crown-8-ether | 4 |
| Nylon resin (Trademark "CM-8000" made by Toray Industries, Inc.) | 4 |
| Methanol | 60 |
| Butanol | 32 |

EXAMPLE 8-4

Example 8-1 was repeated except that the charge generating material (Pigment No. 1 in Table 1) employed in Example 8-1 was replaced by Pigment No. 47 in Table 1, whereby an electrophotographic photoconductor No. 8-4 according to the present invention was prepared.

COMPARATIVE EXAMPLE 8-3

Example 8-4 was repeated except that the dibenzo-18-crown-6-ether was eliminated from the formulation of the intermediate layer coating liquid in Example 8-4, whereby a comparative electrophotographic photoconductor No. 8-3 was prepared.

EXAMPLE 8-5

Example 8-1 was repeated except that the α-phenylstilbene type charge transporting material employed in Example 8-1 was replaced by the following charge transporting material, whereby an electrophotographic photoconductor No. 8-5 according to the present invention was prepared.

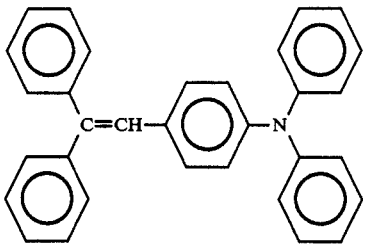

COMPARATIVE EXAMPLE 8-4

Example 8-5 was repeated except that the dibenzo-18-crown-6-ether was eliminated from the formulation of the intermediate layer in Example 8-5, whereby a comparative electrophotographic photoconductor No. 8-4 was prepared.

EXAMPLE 8-6

Example 8-4 was repeated except that the dibenzo-18-crown-6-ether employed in Example 8-4 was replaced by 18-crown-6-ether, whereby an electrophotographic photoconductor No. 8-6 according to the present invention was prepared.

EXAMPLE 8-7

Preparation of Intermediate Layer Coating Liquid

A mixture of the following components was dispersed in a ball mill for 72 hours:

| | Parts by Weight |
|---|---|
| Dibenzo-18-crown-6-ether | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 8-1 was then repeated except that the intermediate layer coating liquid employed in Example 8-1 was replaced by the above prepared intermediate layer coating liquid, whereby an electrophotographic photoconductor No. 8-7 according to the present invention was prepared.

EXAMPLE 8-8

Preparation of Intermediate Layer Coating Liquid

A mixture of the following components was dispersed in a ball mill, whereby an intermediate layer coating liquid was prepared.

| | Parts by Weight |
|---|---|
| Dibenzo-18-crown-6-ether | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 8-1 was repeated except that the intermediate layer coating liquid employed in Example 8-1 was replaced by the above prepared intermediate layer coating liquid, and the intermediate layer coating liquid was coated on the PET film and subjected to a heat treatment at 130° C. for 1 hour, whereby an electrophotographic photoconductor No. 8-8 according to the present invention was prepared.

The electrophotographic photoconductors No. 8-1~No. 8-8 and comparative photoconductors No. 8-1~No. 8-3 were subjected to the same charging and exposing tests as in Example 1-1. The results are shown in the following Table 9:

TABLE 9

| | Before Fatigue | | After Fatigue | |
|---|---|---|---|---|
| | V (Volts) | S (lux.sec) | V' (Volts) | S' (lux.sec) |
| Example 8-1 | −892 | 0.58 | −888 | 0.60 |
| Comp. Ex. 8-1 | −851 | 0.62 | −670 | 0.60 |
| Example 8-2 | −881 | 0.61 | −878 | 0.61 |
| Comp. Ex. 8-2 | −849 | 0.63 | −658 | 0.61 |
| Example 8-3 | −863 | 0.64 | −860 | 0.63 |
| Example 8-4 | −872 | 0.62 | −843 | 0.60 |
| Comp. Ex. 8-3 | −792 | 0.61 | −593 | 0.60 |
| Example 8-5 | −805 | 0.61 | −803 | 0.64 |
| Comp. Ex. 8-4 | −789 | 0.63 | −566 | 0.64 |
| Example 8-6 | −792 | 0.64 | −790 | 0.65 |
| Example 8-7 | −812 | 0.61 | −813 | 0.64 |
| Example 8-8 | −810 | 0.60 | −801 | 0.63 |

EXAMPLE 8-9

The same intermediate layer coating liquid as that employed in Example 8-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 8-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 8-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 8-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −710 V.

EXAMPLE 9-1

Preparation of Intermediate Layer Coating Liquid

A mixture of the following components was dispersed, whereby an intermediate layer coating liquid was prepared:

| | Parts by Weight |
|---|---|
| $HO(CH_2H_4O)_{80}(C_3H_6O)_{30}(C_2H_4O)_{80}H$ (Trademark "Newpol PE68" made by Sanyo Chemical Industries, Ltd.) | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 9-1 according to the present invention was prepared.

COMPARATIVE EXAMPLE 9-1

Example 9-1 was repeated except that Newpol PE68 was eliminated from the formulation of the intermediate layer coating liquid in Example 9-1, whereby a comparative electrophotographic photoconductor No. 9-1 was prepared.

EXAMPLE 9-2

Example 9-1 was repeated except that the intermediate layer coating liquid employed in Example 9-1 was replaced by an intermediate layer coating liquid with the following formulation, whereby an electrophotographic photoconductor No. 9-2 according to the present invention was prepared:

Formulation of Intermediate Layer Coating Liquid

| | Parts by Weight |
|---|---|
| $HO(CH_2H_4O)_{80}(C_3H_6O)_{30}(C_2H_4O)_{80}H$ (Trademark "Newpol PE68" made by Sanyo Chemical Industries, Ltd.) | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 9-2

Example 9-2 was repeated except that Newpol PE68 was eliminated from the formulation of the intermediate layer coating liquid in Example 9-2, whereby a comparative electrophotographic photoconductor No. 9-2 was prepared.

EXAMPLE 9-3

Example 9-1 was repeated except that the intermediate layer coating liquid employed in Example 9-1 was replaced by an intermediate layer coating liquid with the following formulation, whereby an electrophotographic photoconductor No. 9-3 according to the present invention was prepared:

Formulation of Intermediate Layer Coating Liquid

| | Parts by Weight |
|---|---|
| $HO(CH_2H_4O)_{300}(C_3H_6O)_{900}(C_2H_4O)_{300}H$ (Trademark "Newpol 75H-90000" made by Sanyo Chemical Industries, Ltd.) | 0.5 |
| Nylon resin (Trademark "CM-8000" made by Toray Industries, Inc.) | 7.5 |
| Methanol | 60 |
| Butanol | 32 |

EXAMPLE 9-4

Example 9-1 was repeated except that the charge generating material (Pigment No. 1 in Table 1) employed in Example 9-1 was replaced by Pigment No. 47 in Table 1, whereby an electrophotographic photoconductor No. 9-4 according to the present invention was prepared.

COMPARATIVE EXAMPLE 9-3

Example 9-4 was repeated except that Newpol PE68 was eliminated from the formulation of the intermediate layer coating liquid in Example 9-4, whereby a comparative electrophotographic photoconductor No. 9-3 was prepared.

EXAMPLE 9-5

Example 9-4 was repeated except that the α-phenylstilbene type charge transporting material employed in Example 9-4 was replaced by the following charge transporting material, whereby an electrophotographic photoconductor No. 9-5 according to the present invention was prepared.

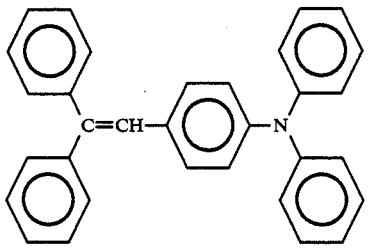

COMPARATIVE EXAMPLE 9-4

Example 9-5 was repeated except that Newpol PE68 was eliminated from the formulation of the intermediate layer in Example 9-5, whereby a comparative electrophotographic photoconductor No. 9-4 was prepared.

EXAMPLE 9-6

Example 9-4 was repeated except that Newpol PE68 employed in Example 9-4 was replaced by $HO\text{-}(CH_2H_4O)_{55}(C_3H_6O)_{35}(C_2H_4O)_{55}H$ (Trademark "Newpol PE77" made by Sanyo Chemical Industries, Ltd.), whereby an electrophotographic photoconductor No. 9-6 according to the present invention was prepared.

EXAMPLE 9-7

Preparation of Intermediate Layer Coating Liquid

A mixture of the following components was dispersed in a ball mill for 72 hours:

| | Parts by Weight |
|---|---|
| $HO\text{-}(CH_2H_4O)_{80}(C_3H_6O)_{30}(C_2H_4O)_{80}H$ (Trademark "Newpol PE68" made by Sanyo Chemical Industies, Ltd.) | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 9-1 was then repeated except that the intermediate layer coating liquid employed in Example 9-1 was replaced by the above prepared intermediate layer coating liquid, whereby an electrophotographic photoconductor No. 9-7 according to the present invention was prepared.

EXAMPLE 9-8

Preparation of Intermediate Layer Coating Liquid

A mixture of the following components was dispersed in a ball mill, whereby an intermediate layer coating liquid was prepared.

| | Parts by Weight |
|---|---|
| $HO\text{-}(CH_2H_4O)_{80}(C_3H_6O)_{30}(C_2H_4O)_{80}H$ (Trademark "Newpol PE68" made by Sanyo Chemical Industries, Ltd.) | 45 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 9-1 was repeated except that the intermediate layer coating liquid employed in Example 9-1 was replaced by the above prepared intermediate layer coating liquid, and the intermediate layer coating liquid was coated on the PET film and subjected to a heat treatment at 130° C. for 1 hour, whereby an electrophotographic photoconductor No. 9-8 according to the present invention was prepared.

The electrophotographic photoconductors No. 9-1 ~ No. 9-8 and comparative photoconductors No. 9-1 ~ No. 9-3 were subjected to the same charging and exposing tests as in Example 1-1. The results are shown in the following Table 10:

TABLE 10

| | Before Fatigue | | After Fatigue | |
|---|---|---|---|---|
| | V (Volts) | S (lux.sec) | V' (Volts) | S' (lux.sec) |
| Example 9-1 | −895 | 0.63 | −894 | 0.62 |
| Comp. Ex. 9-1 | −851 | 0.61 | −670 | 0.60 |
| Example 9-2 | −890 | 0.65 | −891 | 0.67 |
| Comp. Ex. 9-2 | −849 | 0.62 | −658 | 0.61 |
| Example 9-3 | −899 | 0.64 | −901 | 0.63 |
| Example 9-4 | −905 | 0.45 | −910 | 0.44 |
| Comp. Ex. 9-3 | −792 | 0.43 | −593 | 0.42 |
| Example 9-5 | −903 | 0.76 | −896 | 0.75 |
| Comp. Ex. 9-4 | −789 | 0.45 | −566 | 0.45 |
| Example 9-6 | −889 | 0.48 | −893 | 0.49 |
| Example 9-7 | −905 | 0.62 | −902 | 0.60 |
| Example 9-8 | −907 | 0.65 | −903 | 0.67 |

EXAMPLE 9-9

The same intermediate layer coating liquid as that employed in Example 9-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 9-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 9-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 9-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −750 V.

SYNTHESIS EXAMPLE 1

In a reactor fitted with a stirrer, a thermometer, and a reflux condenser, 200 parts by weight of dimethylformamide were placed. The dimethylformamide was heated to 80° C. in an atmosphere of a flowing nitrogen gas. A mixture of the following components was added dropwise to the heated formamide over a period of 1 hour:

| | Parts by Weight |
|---|---|
| $CH_2{=}CH$<br>\|<br>$COOCH_2CH_2OH$ | 50 |
| Azobisisobutyronitrile | 0.2 |

The above reaction mixture was further stirred at the same temperature for 6 hours so as to continue the reaction.

After the termination of the reaction, the reaction mixture was poured into isopropyl ether so as to sedimente a polymer product. The thus obtained polymer product was dried in vacuum at 60° C., which is hereinafter referred to as "Resin A".

SYNTHESIS EXAMPLE 2

A copolymer was prepared in the same manner as in Synthesis Example 1 from the following monomers and azobisisobutyronitrile, which copolymer is hereinafter referred to as "Resin B":

| | Parts by Weight |
|---|---|
| $CH_2{=}C{-}CH_3$<br>\|<br>$COOCH_2CHCH_3$<br>\|<br>$OH$ | 18 |
| $CH_2{=}C{-}CH_3$<br>\|<br>$COOCH_2CHCH_2CH_2CH_2OH$<br>\|<br>$OH$ | 20 |

-continued

| | Parts by Weight |
|---|---|
| $CH_2{=}CH$<br>\|<br>$COOCH_2CHCH_2Cl$<br>\|<br>$OH$ | 12 |
| Azobisisobutyronitrile | 0.2 |

SYNTHESIS EXAMPLE 3

A copolymer was prepared in the same manner as in Synthesis Example 1 from the following monomers and azobisisobutyronitrile, which copolymer is hereinafter referred to as "Resin C":

| | Parts by Weight |
|---|---|
| $CH_2{=}CH{-}CH_3$<br>\|<br>$COOCH_2CH_2OH$ | 25 |
| 2-sulfoethylmethacrylate | 25 |
| Azobisisobutyronitrile | 0.2 |

SYNTHESIS EXAMPLE 4

A copolymer was prepared in the same manner as in Synthesis Example 1 from the following monomers and azobisisobutyronitrile, which copolymer is hereinafter referred to as "Resin D":

| | Parts by Weight |
|---|---|
| $CH_2{=}C{-}CH_3$<br>\|<br>$COOCH_2CHCH_2CH_3$<br>\|<br>$OH$ | 17 |
| methacrylic acid | 4 |
| 2-methacryloxyethyl acid phosphate | 15 |
| 2-methacryloxyethyl phthalic acid | 14 |
| Azobisisobutyronitrile | 0.2 |

EXAMPLE 10-1

Preparation of Intermediate Layer Coating Liquid

A mixture of the following components was dispersed, whereby an intermediate layer coating liquid was prepared:

| | Parts by Weight |
|---|---|
| Resin A (prepared in Synthesis Example 1) | 4 |
| Nylon resin (Trademark "CM-8000" made by Toray Industries, Inc.) | 4 |
| Methanol | 60 |
| Butanol | 32 |

Preparation of Charge Generating Layer Coating Liquid

A charge generating layer coating liquid was prepared in exactly the same manner as in Example 1-1, which contains Azo Pigment No. 1 in Table 1 as charge generating material.

Preparation of Charge Transporting Layer Coating Liquid

A mixture of the following components was mixed and dispersed, whereby a charge transporting layer coating liquid was prepared:

| | Parts by Weight |
|---|---|
| α-phenylstilbene type charge transporting material (which is the same as that employed in Example 1-1) | 10 |
| Polycarbonate (Trademark "Panlite C-1400" made by Teijin Limited) | 10 |
| Silicone oil (Trademark "KF 50" made by Shin-Etsu Chemical Co., Ltd.) | 0.002 |
| Tetrahydrofuran | 80 |

The intermediate layer coating liquid was coated on an Al-deposited PET film (Trademark "Lumirror" made by Toray Industries Inc.) having a thickness of 100 μm by a doctor blade and was then dried at 120° C. for 10 minutes, whereby an intermediate layer having a thickness of 1 μm was formed on the PET film.

On this intermediate layer, the above prepared charge generating layer coating liquid was coated by a doctor blade and was then dried at 120° C. for 10 minutes, whereby a charge generating layer having a thickness of 0.1 μm was formed on the intermediate layer.

Furthermore, the above prepared charge transporting layer coating liquid was coated on the charge generating layer by a doctor blade and was then dried at 120° C. for 20 minutes, whereby a charge transporting layer having a thickness of 20 μm was formed on the charge generating layer. Thus, an electrophotographic photoconductor No. 10-1 according to the present invention was prepared.

COMPARATIVE EXAMPLE 10-1

Example 10-1 was repeated except that "Resin A" was eliminated from the formulation of the intermediate layer coating liquid in Example 10-1, whereby a comparative electrophotographic photoconductor No. 10-1 was prepared.

EXAMPLE 10-2

Example 10-1 was repeated except that the intermediate layer coating liquid employed in Example 10-1 was replaced by an intermediate layer coating liquid with the following formulation, whereby an electrophotographic photoconductor No. 10-2 according to the present invention was prepared:

Formulation of Intermediate Layer Coating Liquid

| | Parts by Weight |
|---|---|
| Resin C (prepared in Synthesis Example 3) | 4 |
| Polyvinyl alcohol (Trademark "Poval B-24" made by Denki Kagaku Kogyo K.K.) | 4 |
| Methanol | 41 |
| Water | 41 |

COMPARATIVE EXAMPLE 10-2

Example 10-2 was repeated except that "Resin C" was eliminated from the formulation of the intermediate layer coating liquid in Example 10-2, whereby a comparative electrophotographic photoconductor No. 10-2 was prepared.

EXAMPLE 10-3

Example 10-1 was repeated except that the intermediate layer coating liquid employed in Example 10-1 was replaced by an intermediate layer coating liquid with the following formulation, whereby an electrophotographic photoconductor No. 10-3 according to the present invention was prepared:

Formulation of Intermediate Layer Coating Liquid

| | Parts by Weight |
|---|---|
| Resin B (prepared in Synthesis Example 2) | 4 |
| Nylon resin (Trademark "CM-8000" made by Toray Industries, Inc.) | 4 |
| Methanol | 60 |
| Butanol | 32 |

EXAMPLE 10-4

Example 10-1 was repeated except that the α-phenylstilbene type charge transporting material employed in Example 10-1 was replaced by the following charge transporting material, whereby an electrophotographic photoconductor No. 10-4 according to the present invention was prepared.

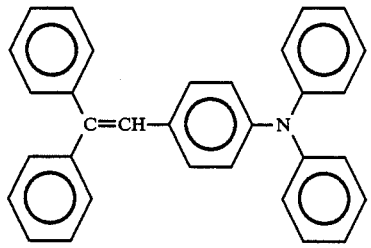

COMPARATIVE EXAMPLE 10-3

Example 10-4 was repeated except that "Resin A" was eliminated from the formulation of the intermediate layer coating liquid in Example 10-4, whereby a comparative electrophotographic photoconductor No. 10-3 was prepared.

EXAMPLE 10-5

Preparation of Intermediate Layer Coating Liquid

A mixture of the following components was dispersed in a ball mill for 72 hours:

| | Parts by Weight |
|---|---|
| Resin A (prepared in Synthesis Example 1) | 5 |
| Nylon resin (Trademark "CM-8000" made by Toray Industries, Inc.) | 5 |
| Finely-divided tin oxide particles | 5 |
| Titanium oxide powder | 3 |
| Methanol | 40 |

The above dispersion was diluted with a mixed solvent of methanol/butanol (20:30 on parts-by-weight basis) and dispersed again in the ball mill for 48 hours, whereby an intermediate layer coating liquid was prepared.

Example 10-1 was then repeated except that the intermediate layer coating liquid employed in Example 10-1 was replaced by the above prepared intermediate layer coating liquid, whereby an electrophotographic photoconductor No. 10-5 according to the present invention was prepared.

EXAMPLE 10-6

Preparation of Intermediate Layer Coating Liquid

A mixture of the following components was dispersed in a ball mill, whereby an intermediate layer coating liquid was prepared.

| | Parts by Weight |
|---|---|
| Resin A (prepared in Synthesis Example 1) | 48 |
| Polyvinyl butyral resin (Trademark "BL-1" made by Sekisui Chemical Co., Ltd.) | 48 |
| Finely-divided tin oxide particles | 48 |
| Tolylenediisocyanate | 14.5 |
| Cyclohexanone | 552 |
| Methyl ethyl ketone | 130 |

Example 10-1 was repeated except that the intermediate layer coating liquid employed in Example 10-1 was replaced by the above prepared intermediate layer coating liquid, which was coated on the PET film and subjected to a heat treatment at 130° C. for 1 hour, whereby an electrophotographic photoconductor No. 10-6 according to the present invention was prepared.

The electrophotographic photoconductors No. 10-1~No. 10-6 and comparative photoconductors No. 10-1~No. 19-3 were subjected to the same charging and exposing tests as in Example 1-1. The results are shown in the following Table 11:

TABLE 11

| | Before Fatigue | | After Fatigue | |
|---|---|---|---|---|
| | V (Volts) | S (lux.sec) | V' (Volts) | S' (lux.sec) |
| Example 10-1 | −887 | 0.58 | −885 | 0.57 |
| Comp. Ex. 10-1 | −851 | 0.62 | −670 | 0.60 |
| Example 10-2 | −885 | 0.60 | −879 | 0.61 |
| Comp. Ex. 10-2 | −849 | 0.63 | −658 | 0.61 |
| Example 10-3 | −842 | 0.61 | −840 | 0.62 |
| Example 10-4 | −850 | 0.63 | −844 | 0.62 |
| Comp. Ex. 10-3 | −793 | 0.66 | −590 | 0.63 |
| Example 10-5 | −838 | 0.60 | −820 | 0.61 |
| Example 10-6 | −851 | 0.62 | −843 | 0.62 |

EXAMPLE 10-7

The same intermediate layer coating liquid as that employed in Example 10-1 was coated on the external surface of an aluminum drum with a wall thickness of 3 mm, a diameter of 80 mm and a length of 340 mm by immerse coating and was then heated and dried at 130° C. for 20 minutes, whereby an intermediate layer having a thickness of 1 μm was formed.

On the thus formed intermediate layer, the same charge generating layer coating liquid as that employed in Example 10-1 was coated by immerse coating. The coated liquid was heated and dried at 130° C. for 20 minutes, whereby a charge generating layer having a thickness of 0.1 μm was formed on the intermediate layer.

Furthermore, on the thus formed charge generating layer, the same charge transporting layer coating liquid as that employed in Example 9-1 was coated by immerse coating. The coated liquid was heated and dried at 130° C. for 30 minutes, whereby a charge transporting layer having a thickness of 20 μm was formed on the charge generating layer, whereby an electrophotographic photoconductor No. 10-9 in the shape of a drum according to the present invention was prepared.

The thus prepared photoconductor drum was incorporated in the same modified copying machine as that employed in Example 1-1. By use of this copying machine, copies were made. The result was that clear copy images were obtained.

The surface potential of the photoconductor immediately after the photoconductor passed under the charger for image formation was measured. The result was −800 V. The cycle of the charging and exposure was repeated 10,000 times and copies were made in the same manner as mentioned above. The result was that the image density was not decreased at all and the surface potential of the photoconductor was −730 V.

According to the present invention, electrophotographic photoconductors capable of yielding excellent images, with high photosensitivity retained, and without any deterioration of the charging characteristics, any decrease of image density, any toner deposition on the background of images, even if used in repetition for an extended period of time.

What is claimed is:

1. An electrophotographic photoconductor comprising an electroconductive support, an intermediate layer formed thereon, and a photoconductive layer formed on said intermediate layer, which intermediate layer comprises at least one component selected from the group consisting of:

(1) monohydric aliphatic alcohol,
(2) dihydric aliphatic alcohol,
(3) polyethylene glycol monoester and/or polyethylene glycol diester,
(4) polyethylene glycol monoether,
(5) crown ether,
(6) a random or block copolymer having as structure units a hydroxethylene group and a hydroxypropylene group, and hydroxyl groups at the terminal thereof, and
(7) a polymer of a monomer having formula (I) and a copolymer of said monomer and a counterpart monomer:

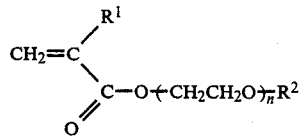

(I)

wherein $R^1$ is hydrogen or a methyl group; $R^2$ is hydrogen, a lower alkyl group or an unsubstituted or substituted aryl group; and n is an integer of 2 to 100.

2. An electrophotographic photoconductor comprising an electroconductive support, an intermediate layer formed thereon, an a photoconductive layer formed on said intermediate layer, which intermediate layer comprises at least one component selected from the group consisting of: (a) monohydric aliphatic alcohol, and (b) dihydric aliphatic alcohol.

3. An electrophotographic photoconductor comprising an electroconductive support, an intermediate layer formed thereon, an a photoconductive layer formed on said intermediate layer, which intermediate layer comprises at least one component selected from the group consisting of: (a) polyethylene glycol monoester and (b) polyethylene glycol diester.

4. An electrophotographic photoconductor comprising an electroconductive support, an intermediate layer formed thereon, an a photoconductive layer formed on said intermediate layer, which intermediate layer comprises at least one component selected from the group consisting of: (a) polyethylene glycol monoether, and (b) crown ether.

5. An electrophotographic photoconductor comprising an electroconductive support, an intermediate layer formed thereon, an a photoconductive layer formed on said intermediate layer, which intermediate layer comprises at least one component selected from the group consisting of: (a) a random or block copolymer having as structure units a hydroxyethylene group and a hydroxypropylene group, and hydroxyl groups at the terminal thereof, and (b) a polymer of a monomer having formula (I) and a copolymer of said monomer and a counterpart copolymerizable monomer:

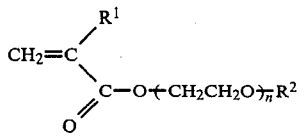

(I)

wherein $R^1$ is hydrogen or a methyl group; $R^2$ is hydrogen, a lower alkyl group or an unsubstituted or substituted aryl group; and n is an integer of 2 to 100.

6. The electrophotographic photoconductor according to claim 1, wherein said intermediate layer further comprises a binder resin.

7. The electrophotographic photoconductor according to claim 2, wherein said intermediate layer further comprises a binder resin.

8. The electrophotographic photoconductor according to claim 3, wherein said intermediate layer further comprises a binder resin.

9. The electrophotographic photoconductor according to claim 4, wherein said intermediate layer further comprises a binder resin.

10. The electrophotographic photoconductor according to claim 5, wherein said intermediate layer further comprises a binder resin.

* * * * *